United States Patent [19]

Arakawa et al.

[11] Patent Number: 4,567,135

[45] Date of Patent: Jan. 28, 1986

[54] SILVER HALIDE COLOR PHOTOGRAPHIC LIGHT-SENSITIVE MATERIAL

[75] Inventors: Jun Arakawa; Toshiyuki Watanabe, both of Kanagawa, Japan

[73] Assignee: Fuji Photo Film Co., Ltd., Kanagawa, Japan

[21] Appl. No.: 572,048

[22] Filed: Jan. 19, 1984

[30] Foreign Application Priority Data

Jan. 19, 1983 [JP] Japan ..... 58-7155

[51] Int. Cl.[4] ..... G03C 1/46

[52] U.S. Cl. ..... 430/505; 430/549; 430/553; 430/555; 430/557; 430/558

[58] Field of Search ..... 430/549, 505, 553, 555, 430/557, 558, 223

[56] References Cited

U.S. PATENT DOCUMENTS

| | | | |
|---|---|---|---|
| 3,726,681 | 4/1973 | Pankow et al. | 430/506 |
| 4,170,479 | 10/1979 | Usami | 430/509 |
| 4,264,723 | 4/1981 | Ichijima et al. | 430/387 |
| 4,366,237 | 12/1982 | Ichijima et al. | 430/558 |
| 4,420,556 | 12/1983 | Booms et al. | 430/549 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material is disclosed. The material is comprised of a support base having thereon a silver halide emulsion layer and two distinct types of couplers. One coupler is a diffusing dye-forming coupler which can form a dye capable of having moderate diffusibility in an emulsion layer through coupling with an oxidation product of a color developing agent. The other coupler is a high reaction rate coupler which can form a dye of the same color as that of the diffusing dye-forming coupler and that, has a coupling speed higher than that of the diffusing dye-forming coupler by a factor of 1.3 to 15. By utilizing the two types of couplers in combination with each other the resulting material can provide images with improved graininess over the entire density region of the dye image.

9 Claims, 2 Drawing Figures

SILVER HALIDE COLOR PHOTOGRAPHIC LIGHT-SENSITIVE MATERIAL

FIELD OF THE INVENTION

The present invention relates to a color photographic light-sensitive material and more particularly, to a silver halide color photographic light sensitive material having high sensitivity and improved graininess.

BACKGROUND OF THE INVENTION

It is very difficult in a silver halide photographic light-sensitive material to satisfy both requirements of high sensitivity and excellent graininess. Therefore, the simultaneous satisfaction of both requirements has been an important theme in this art. For instance, although imparting high sensitivity to a silver halide photographic material can be achieved by increasing the size of silver halide grains, its graininess is greatly impaired if it is left intact without adopting any proper measures. Accordingly, with color photographic light-sensitive materials containing coarse-grained silver halide emulsions, the graininess has so far been improved by using particular couplers. As one of the measures, there has been the combined use of coarse-grained silver halide emulsions with so-called DIR couplers described in U.S. Pat. No. 3,227,554 or DIR compounds described in U.S. Pat. No. 3,632,435. Such DIR couplers and DIR compounds have a function to reduce clouds of the dye. Accordingly, the graininess is expected to be improved. However, such a measure decrease the sensitivity due to inhibitors released upon development and, does not improve the graininess in high density areas.

As another measure, an improvement in the graininess using diffusibility of dyes to be produced has been attempted in Japanese patent application (OPI) No. 82837/82 and so on. The so-called R.M.S. granularity (which is described in T. H. James, *Theory of the Photographic Process,* 4th Ed., p. 619) is greatly improved by using non-diffusing couplers capable of producing diffusing dyes which are moderate in smearing (which are simply called "diffusing dye-forming couplers" hereinafter). However, in middle and high density areas smears of dye, which each is formed in the periphery of developed spot through diffusion of dye molecules, adjacent to one another come to mingle therewith to form great overlaps of dye clouds and consequently, results in random formation of huge dye clouds since the arrangement of silver halide grains and the probability of development obey the random process. This phenomenon is visually quite disagreeable, and the graininess makes a rather bad appearance in the middle and high density areas, as the case may be.

That is, on the occasion that diffusing dye-forming couplers are employed, individual dye clouds come to have a low population density of dye and a large area as the result of dye molecules' diffusing in all direction with the same concentration inside the dye cloud (which are named "a dye cloud of diffusion type" hereinafter). Therefore, if graininess is expressed in the form of the so-called R.M.S. value, an improved value is derived. However, in areas of middle or higher densities large mottles formed by several dye clouds' gathering attract our attention and therefore, we get the impression that the graininess is visually poor. On the other hand, if the graininess is expressed in the form of Wiener spectrum (for detail of which T. H. James, *The Theory of Photographic Process*, 4th Ed., p. 621 should be referred to), diffusing dye-forming couplers are employed only to increase values corresponding to the low spatial frequency portion of the Wiener spectrum. (Such a value means better graininess the lower it is.) In practice also, though the graininess expressed in a form of R.M.S. value is improved by the use of diffusing dye-forming couplers, the resulting dye image assumes a quite disagreeable aspect and creates the impression that the graininess is deteriorated.

SUMMARY OF THE INVENTION

It has now been found that if such a coupler as to undergo the coupling reaction at a higher rate than the diffusing dye-forming coupler and that, to produce a nondiffusible dye (which is simply called "a high reaction rate coupler" hereinafter) is present in the system as described above, characteristic values of R.M.S. granularity in middle and high density areas (more specifically in areas having densities of minimum density+0.5 or above) are improved and at the same time, visually disagreeable aspects which the diffusing dye-forming coupler imparts to color images can be removed.

It can be assumed that high reaction rate couplers have a comparatively great effect on disappearance of graininess in middle and high image density areas and consequently, they can contribute to improvement in characteristic values of R.M.S. granularity and further, can give lesser prominence to mottles due to huge dye clouds generated by diffusing dye-forming couplers in middle and high image density areas to result in removal of visually disagreeable aspects from the dye images.

On the other hand, though graininess in low density areas is aggrevated by using high reaction rate couplers, the combined use with diffusing dye-forming couplers, which is to be embodied in this invention, can improve on the graininess in low density areas.

The present invention makes it possible to have simultaneous improvements in both granularity and visual graininess over whole areas of a certain emulsion layer.

This invention may be applied not only when the above-described two types of couplers are incorporated in the same layer, but also when they are incorporated in a group of emulsion layers differing in photographic speed, though having the same color sensitivity. In the latter case, a high reaction rate coupler is incorporated in the layer which controls the middle and high density parts, e.g., in the low-sensitive emulsion layer when the group is composed of two layers, or in both the low-sensitive and the intermediate-sensitive emulsion layers when the group is composed of three layers, and a diffusing dye-forming coupler is incorporated in the layer which controls the low density part, e.g., in the high-sensitive emulsion layer. The object of this invention can also be attained by incorporating both the high reaction rate coupler and the diffusing dye-forming coupler in all of emulsion layers constituting the group, though adjusting a fraction of the latter coupler to more than 50% in the layer which controls the low density part and that of the former coupler to more than 50% in the layer which controls the middle and high density parts.

This invention can achieve the object of improving in graininess over the whole density region even if other conventional couplers are copresent.

An object of this invention is to improve graininess (including visual graininess) over the whole density region of some color forming layers; i.e., a cyan color forming layer, a magenta color forming layer or a yellow color forming layer.

The above-described object is attained with a silver halide color light-sensitive material containing a combination of (1) a diffusing dye-forming coupler and (2) a coupler which forms a dye of the same color as that of the diffusing dye-forming coupler and which has a coupling speed higher than that of the diffusing dye-forming coupler by a factor of 1.3 to 15, preferably 1.5 to 10.

A diffusing dye-forming coupler bottom a side-effect of deteriorating sharpness, while a high reaction rate coupler makes it possible to reduce the amount of silver and in its turn, reduce the thickness of a silver halide emulsion layer. Therefore, deterioration of sharpness can be also prevented by this invention.

Another object of this invention is, therefore, to provide a silver halide color photographic light-sensitive material which is improved in visual graininess without deterioration of sharpness.

This object also can be attained with a silver halide color photographic light-sensitive material containing the above-described combination of couplers.

DETAILED DESCRIPTION OF THE INVENTION

Figure 1:
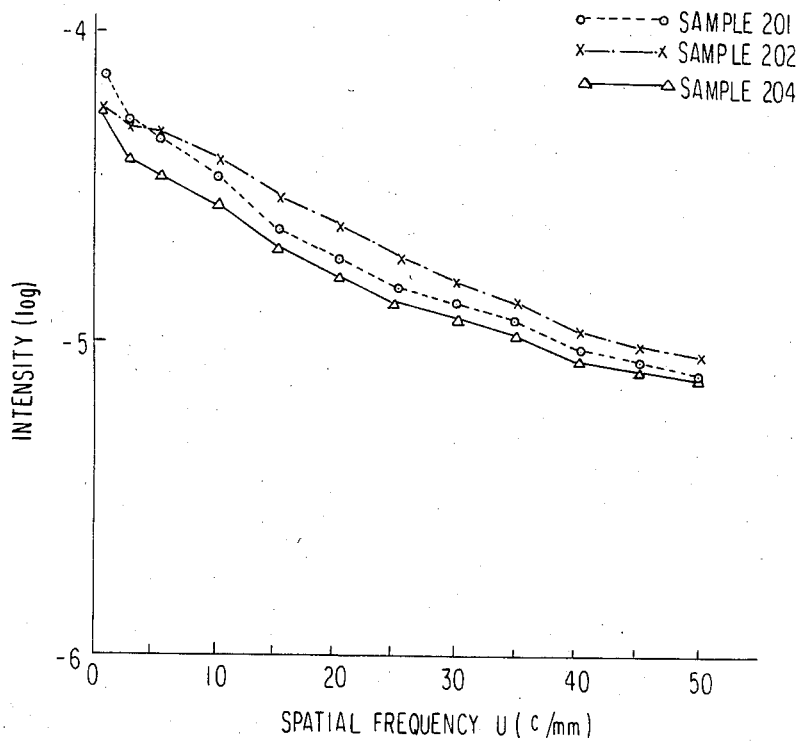
FIG. 1 shows the Wiener spectra of magneta images of Sample 201, Sample 202 and Sample 204 respectively.

The present invention is a silver halide color photographic light-sensitive material. The material is comprised of a support base having a silver halide emulsion layer thereon and two distinct types of couplers. One type of coupler can be referred to as a non-diffusing coupler which can form a dye capable of having moderate diffusibility in an emulsion layer through the coupling with an oxidation product of a color developing agent. This coupler will hereinafter be referred to as a diffusing dye-forming coupler. The other type of coupler forms a nondiffusible dye having the same color as the diffusing dye-forming coupler but has coupling reaction rate higher than that of the diffusing dye-forming coupler by a factor of 1.3 to 15. This coupler will hereinafter be referred to as a high reaction rate coupler. By including both types of couplers in the material it is impossible to obtain a material which produces images having improved graininess over the entire density region of the dye image.

The amount of the diffusing dye-forming coupler being added is from 0.005 mole to 0.2 mole, preferably from 0.01 to 0.05 mole, per mole of silver.

The amount of the high reaction rate coupler being added is from 0.01 mole to 30 moles, preferably from 0.05 mole to 10 moles, per mole of the diffusing dye-forming coupler.

The coupling reactivity (i.e., coupling reaction rate) of a coupler can be determined as relative value with using a different dye forming coupler as a standard (i.e., coupler N used herebelow). That is, a coupler M (of which coupling reaction rate should be determined) is mixed with a standard coupler N wherein the coupler M and the coupler N provide different dyes which can be clearly separated from each other. The mixture of the couplers M and N is added to a silver halide emulsion layer followed by color development to form a color image. The amounts of each dye formed in the color image are measured and, therefrom, the coupling reactivity of the coupler M is determined as a relative value in the following manner.

When the maximum color density of coupler M is shown by (DM)max, the color density of coupler M in an intermediate step is shown by DM, the maximum color density of coupler N is shown by (DN)max, and the color density of coupler N is an intermediate step is shown by DN, the ratio of the reactivities of both couplers, RM/RN is shown by the following equation:

$$\frac{RM}{RN} = \frac{\log\left(1 - \frac{DM}{(DM)\text{max}}\right)}{\log\left(1 - \frac{DN}{(DN)\text{max}}\right)}$$

That is, the silver halide emulsion containing a mixture of the couplers M and N is step-wise exposed and followed by color development to obtain several sets of DM and DN. The combinations of DM and DN obtained are plotted as $\log(1-D/D_{max})$ onto a graph of two axis perpendicularly intersecting each other to obtain a straight line. The coupling activity ratio RM/RN is obtained from the inclination of the straight line.

Thus, by measuring RM/RN values of various couplers M using a definite coupler N in the manner as described above, coupling reactivities are relatively obtained.

In this invention, the following couplers were used as the foregoing definite coupler N.

For measuring the coupling reactivity of cyan couplers, the following magenta coupler was used as the coupler N.

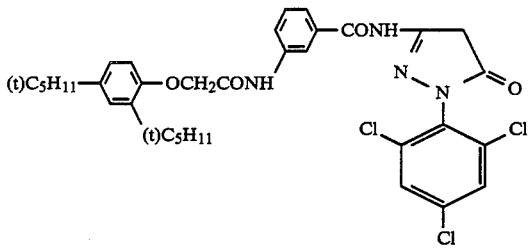

For measuring the coupling reactivity of magenta couplers and yellow couplers, the following cyan coupler was used as the coupler N.

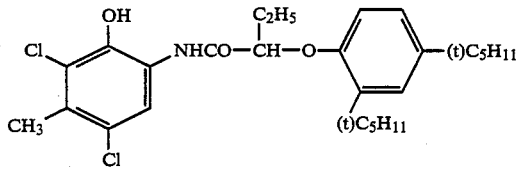

Although both diffusing dye-forming couplers and high reaction rate couplers were very difficult to use from the practical point of view because of their great disadvantages as described above, the combined use of them enables attainments of high image quality and high sensitivity in the whole density areas. That is to say, in the low density part the visual graininess is greatly improved through the smearing effect of a diffusing dye-forming coupler, whereas the graininess in parts having middle or higher densities is also remarkably improved for the reasons that a rapid progress of the reaction of a high reaction rate coupler with an oxidation product of a developing agent not only diminishes a development inhibiting effect attributable to the oxidation product of the color developing agent, but also increases the amount of developed silver in high exposure density areas to result in participation of all of the coated coupler molecules in the reaction and therethrough, graininess becomes inconspicuous. That is to say, a quick disappearance of graininess occurs and at the same time, the formation of large mottles, which is the defect of a diffusing dye-forming coupler, is also checked. In addition, as the ability of imparting high sensitivity and high sharpness to a sensitive material, which is the advantage of a high reaction rate coupler, is kept alive, this invention makes it possible to provide a silver halide photographic light-sensitive material having very high image quality and high sensitivity.

Diffusing dye-forming couplers as used herein include those compounds represented by the general formula (1):

$$(C_p)_a X \quad (1)$$

wherein $C_p$ represents a diffusible coupler component which allows a dye image to exhibit controlled smearing and improve granularity, X represents a ballast group containing from 8 to 32 carbon atoms which is bound to the coupler component at the coupling position and is released through a reaction with an oxidation product of a color developing agent, and a is 1 or 2.

Of the couplers represented by the general formula (1), preferred couplers are represented by the following general formulae:

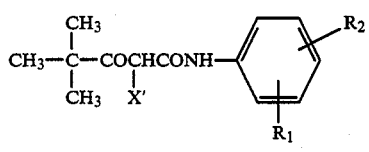
(I)

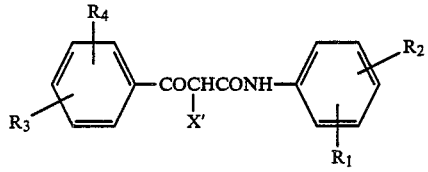
(II)

In the foregoing general formulae (I) and (II), $R_1$, $R_2$, $R_3$ and $R_4$ may be the same or different, and are each a hydrogen atom, a halaogen atom, an alkyl group (e.g., a methyl group, an ethyl group, an isopropyl group, and a hydroxyethyl group), an alkoxy group (e.g., a methoxy group, an ethoxy group, and a methoxyethoxy group), an aryloxy group (e.g., a phenoxy group), an acylamino group (e.g., an acetylamino group, and a trifluoroacetylamino group), a sulfonamino group (e.g., a methanesulfonamino group, and a benzenesulfonamino group), a carbamoyl group, a sulfamoyl group, an alkylthio group, an alkylsulfonyl group, an alkoxycarbonyl group, a ureido group, a cyano group, a carboxyl group, a hydroxy group, or a sulfo group, provided that the total number of carbon atoms contained in $R_1$, $R_2$, $R_3$ and $R_4$ is not more than 10, and X' is a group which contains a so-called ballast group containing from 8 to 32 carbon atoms, providing non-diffusibility to the coupler, and which is capable of being released through a coupling reaction with an oxidation product of an aromatic primary amine developer.

In more detail, the group X' can be represented by the following general formula (III) or (IV):

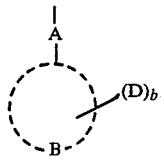
(III)

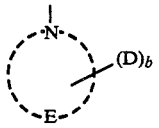
(IV)

In the foregoing formulae (III) and (IV), A represents an oxygen atom or a sulfur atom, B represents a non-metal atom group required for forming an aryl ring or a heterocyclic ring (preferably a 5- or 6-membered heterocyclic ring), and E represents a non-metal atom group required for forming a 5- or 6-membered heterocyclic ring in combination with a nitrogen atom. These rings may further condense with an aryl ring or a heterocyclic ring. D represents a ballast group, and b is a positive integer. When b is more than 1, D may be the same or different, and the total number of carbon atoms is from 8 to 32. D may contain connecting or linking groups, e.g., —O—, —S—, —COO—, —CONH—, —$SO_2$NH—, —NHCONH—, —$SO_2$—, —CO—, and —NH—.

Of the couplers represented by the general formula (1) preferred additional compounds are represented by the following formulae (V), (VI) and (VII):

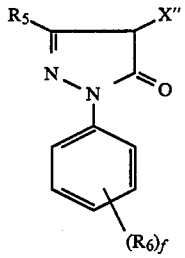
(V)

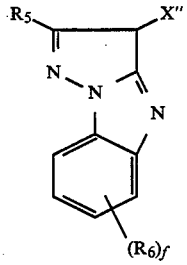
(VI)

-continued

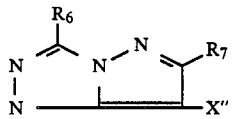

(VII)

In the foregoing formulae (V), (VI) and (VII), $R_5$ is an acylamino group (e.g., a propanamido group and a benzamido group), an anilino group (e.g., a 2-chloroanilino group and a 5-acetamidoanilino group), or a ureido group (e.g., a phenylureido group and a butaneureido group), $R_6$ and $R_7$ are each selected from a halogen atom, an alkyl group (e.g., a methyl group and an ethyl group), an alkoxy group (e.g., a methoxy group and an ethoxy group), an acylamino group (e.g., an acetamido group and a benzamido group), an alkoxycarbonyl group (e.g., a methoxycarbonyl group), an N-alkylcarbamoyl group (e.g., an N-methylcarbamoyl group), a ureido group (e.g., an N-methylureido group), a cyano group, an aryl group (e.g., a phenyl group and a naphthyl group), an N,N-dialkylsulfamoyl group, a nitro group, a hydroxyl group, a carboxyl group, an aryloxy group, etc., and f is 0 or an integer of from 1 to 4. When f is 2 or more, $R_6$ may be the same or different. In the general formulae (V) and (VI), however, the total number of carbon atoms contained in $R_5$ and $(R_6)_f$ does not exceed 10, and in the general formula (VII), the total number of carbon atoms in $R_6$ and $R_7$ does not exceed 10. X'' represents the following general formula (VIII), (IX) or (X):

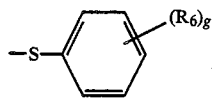

(VIII)

$-S-R_8$ (IX)

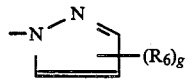

(X)

In the foregoing formulae (VIII) and (X), $R_6$ is selected from the groups described in the general formulae (V) to (VII), and when g is 2 or more, $R_6$ may be the same or different. The total number of carbon atoms contained in $(R_6)_g$ is from 8 to 32.

$R_8$ may be substituted or unsubstituted, and is an alkyl group (e.g., a butyl group and a dodecyl group), an aralkyl group (e.g., a benzyl group), an alkenyl group (e.g., an allyl group), or a cyclic alkyl group (e.g., a cyclopentyl group). Substituents which can be used include a halogen atom, an alkoxy group (e.g., a butoxy group and a dodecyloxy group), an acylamido group (e.g., an acetamido group and a tetradecanamido group), an alkoxycarbonyl group (e.g., a tetradecyloxycarbonyl group), an N-alkylcarbamoyl group (e.g., an N-dodecylcarbamoyl group), a ureido group (a tetradecylureido group), a cyano group, an aryl group (e.g., a phenyl group), a nitro group, an alkylthio group (e.g., a dodecylthio group), an alkylsulfinyl group (e.g., a tetradecylsulfinyl group), an alkylsulfone group, an anilino group, a sulfonamido group (e.g., a hexadecanesulfonamido group), an N-alkylsulfamoyl group, an aryloxy group, and an acyl group (e.g., a tetradecanoyl group). The total number of carbon atoms contained in $R_8$ is from 8 to 32.

Of the couplers represented by the general formula (1) additional compounds which are preferred are represented by the following general formulae (XI) and (XII):

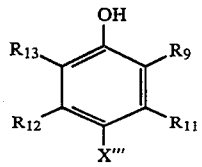

(XI)

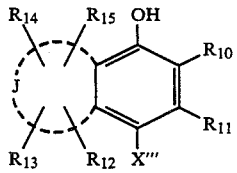

(XII)

In the foregoing formulae (XI) and (XII), $R_9$ is a hydrogen atom, an aliphatic group containing 10 or less carbon atoms (e.g., an alkyl group such as methyl, isopropyl, acyl, cyclohexyl, or octyl), an alkoxy group containing 10 or less carbon atoms (e.g., methoxy, isopropoxy and pentadecyloxy), an aryloxy group (e.g., phenoxy and p-tert-butylphenoxy), an acylamido group, a sulfonamido group and a ureido group represented by the general formulae (XIII) to (XV) as described below, or a carbamoyl group represented by the general formula (XVI) as described below.

$-NH-CO-G$ (XIII)

$-NH-SO_2-G$ (XIV)

$-NHCONH-G$ (XV)

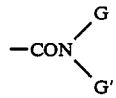

(XVI)

wherein G and G' may be the same or different, and are each a hydrogen atom (provided that G and G' are not hydrogen atoms at the same time and that the total number of carbon atoms contained in G and G' is from 1 to 12), an aliphatic group containing from 1 to 12 carbon atoms, preferably a straight or branched alkyl group or a cyclic alkyl group (e.g., cyclopropyl, cyclohexyl and norbornyl) containing from 4 to 10 carbon atoms, or an aryl group (e.g., phenyl and naphthyl); the alkyl and aryl groups may be substituted by a halogen atom (e.g., fluorine and chlorine), a nitro group, a cyano group, a hydroxy group, a carboxy group, an amino group (e.g., amino, alkylamino, dialkylamino, anilino and N-alkylanilino), an alkyl group (e.g., those as described above), an aryl group (e.g., phenyl and acetylaminophenyl), an alkoxycarbonyl group (e.g., butyloxycarbonyl), an acyloxycarbonyl group, an amido group (e.g., acetamido and methanesulfonamido), an imido group (e.g., succinic acid amide), a carbamoyl group (e.g., N,N-diethylcarbamoyl), a sulfamoyl group (e.g., N,N-diethylsulfamoyl), an alkoxy group (e.g., ethoxy, butyloxy and octyloxy), an aryloxy group (e.g., phenoxy and methylphenoxy), etc.

$R_9$ may contain commonly used substituents in addition to the above-described substituents.

$R_{10}$ is a hydrogen atom, an aliphatic group containing 12 or less carbon atoms, preferably an alkyl group containing from 1 to 10, or a carbamoyl group represented by the general formula (XVI).

$R_{11}$, $R_{12}$, $R_{13}$, $R_{14}$ and $R_{15}$ are each a hydrogen atom, a halogen atom, an alkyl group, an aryl group, an alkoxy group, an alkylthio group, a heterocyclic group, an amino group, a carbonamido group, a sulfonamido group, a sulfamyl group, or a carbamyl group.

In greater detail, $R_{11}$ represents:

a hydrogen atom, a halogen atom (e.g., chlorine and bromine), a primary, secondary or tertiary alkyl group containing from 1 to 12 carbon atoms (e.g., methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl)ethyl, and 2-aminoethyl), an alkylthio group (e.g., octylthio), an aryl group (e.g., phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl and 3-ethylnaphthyl), a heterocyclic ring group (e.g., a benzofuranyl group, a furanyl group, a thiazolyl group, a benzothiazolyl group, a naphthothiazolyl group, an oxazolyl group, a benzoxazolyl group, a naphthoxazolyl group, a pyridyl group and a quinolinyl group), an amino group (e.g., amino, methylamino, diethylamino, dodecylamino, phenylamino, tolylamino, 4-cyanophenylamino, 2-trifluoromethylphenylamino and benzothiazoleamino), a carbonamido group (e.g., alkylcarbonamido such as ethylcarbonamido and decylcarbonamido; arylcarbonamido such as phenylcarbonamido, 2,4,6-trichlorophenylcarbonamido, 4-methylphenylcarbonamido, 2-ethoxyphenylcarbonamido, and naphthylcarbonamido; and heterocyclic carbonamido such as thiazolylcarbonamido, benzothiazolylcarbonamido, naphthothiazolylcarbonamido, oxazolylcarbonamido, benzoxazolylcarbonamido, imidazolylcarbonamido, and benzimidazolylcarbonamido), a sulfonamido group (e.g., alkylsulfonamido such as butylsulfonamido, dodecylsulfonamido and phenylethylsulfonamido; arylsulfonamido such as phenylsulfonamido, 2,4,6-trichlorophenylsulfonamido, 2-methoxyphenylsulfonamido, 3-carboxyphenylsulfonamido and naphthylsulfonamido; and heterocyclic sulfonamido such as thiazolylsulfonamido, benzothiazolylsulfonamido, imidazolylsulfonamido, benzimidazolylsulfonamido, and pyridylsulfonamido), a sulfamyl group (e.g., alkylsulfamyl such as propylsulfamyl, octylsulfamyl; arylsulfamyl such as phenylsulfamyl, 2,4,6-trichlorophenylsulfamyl, 2-methoxyphenylsulfamyl, naphthylsulfamyl; and heterocyclic sulfamyl such as thiazolylsulfamyl, benzothiazolylsulfamyl, oxazolylsulfamyl, benzimidazolylsulfamyl and pyridylsulfamyl), and a carbamyl group (e.g., alkylcarbamyl such as ethylcarbamyl and octylcarbamyl; arylcarbamyl such as phenylcarbamyl and 2,4,6-trichlorophenylcarbamyl; and heterocyclic carbamyl groups such as thiazolylcarbamyl, benzothiazolylcarbamyl, oxazolylcarbamyl, imidazolylcarbamyl and benzimidazolylcarbamyl).

$R_{12}$, $R_{13}$, $R_{14}$ and $R_{15}$ can be the atoms and the groups described in detail in $R_{11}$.

J represents a non-metal group necessary for forming a 5- or 6-membered ring, e.g., a benzene ring, a cyclohexene ring, a cyclopentene ring, a thiazole ring, an oxazole ring, an imidazole ring, a pyridine ring, and a pyrrole ring. Of these rings, a benzene ring is preferred.

X''' represents a group which contains from 8 to 32 carbon atoms, is bound through —O—, —S—, or —N=N— to the coupling position, and is capable of being released through a coupling reaction with an oxidation product of an aromatic primary amine developer. Preferred examples are an alkoxy group, an aryloxy group, an alkylthio group, and an arylthio group, containing from 8 to 32 carbon atoms. These groups may further contain divalent groups such as —O—, —S—, —NH—, —CONH—, —COO—, —$SO_2$NH—, —SO—, —$SO_2$—, —CO—,

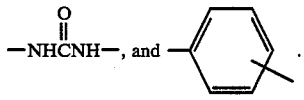

Moreover, it is particularly preferred that the groups contain such groups as —COOH, —$SO_3$H, —OH and —$SO_2NH_2$, which are dissociated by alkali.

By suitably combining $R_9$, $R_{10}$, $R_{11}$, $R_{12}$, $R_{13}$, $R_{14}$, $R_{15}$, and X''', couplers can be made substantially non-diffusing. For example, couplers can be made non-diffusing by sole substituent containing from 8 to 32 carbon atoms or two or more substituents which effect each other and show the same result as that of the substituent containing from 8 to 32 carbon atoms due to the combination thereof.

Specific examples of the diffusing dye-forming coupler are illustrated below.

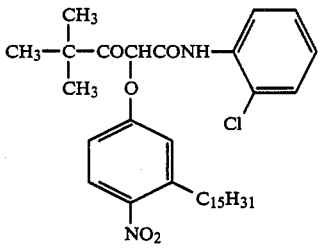

Y - 1

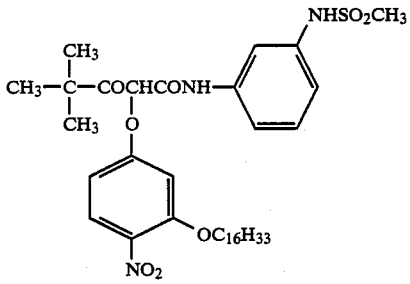

Y - 2

-continued
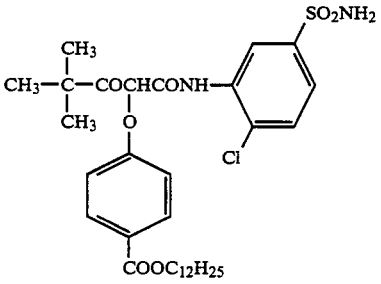
Y - 3
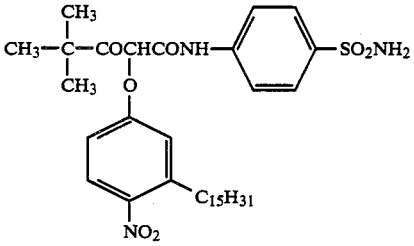
Y - 4
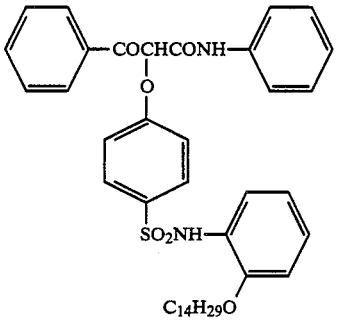
Y - 5
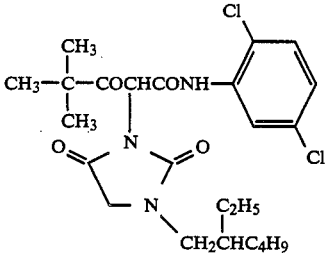
Y - 6
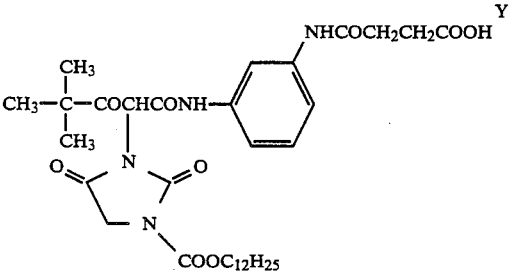
Y - 7
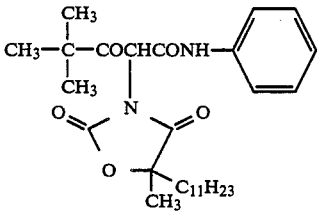
Y - 8
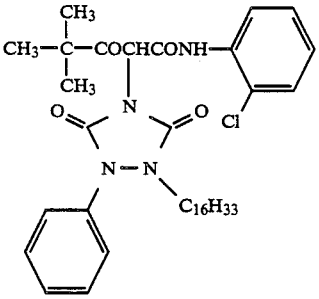
Y - 9
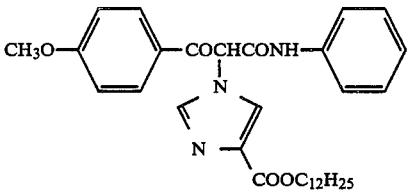
Y - 10
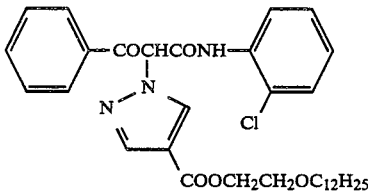
Y - 11
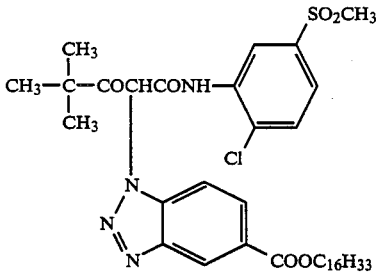
Y - 12

-continued
Y - 13
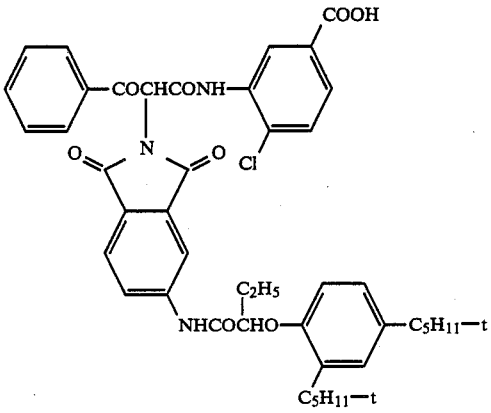
Y - 14
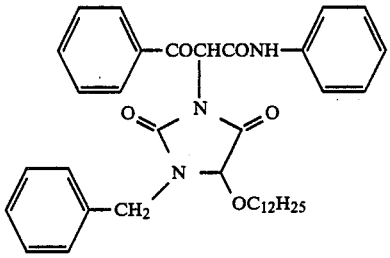
Y - 15
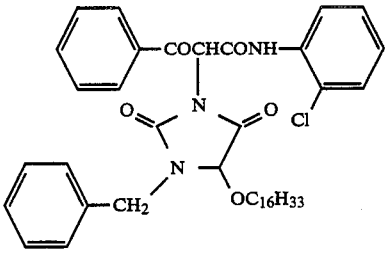
M - 1
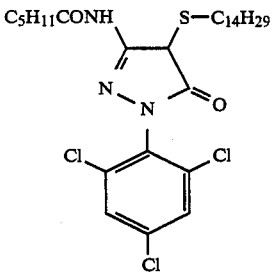
M - 2
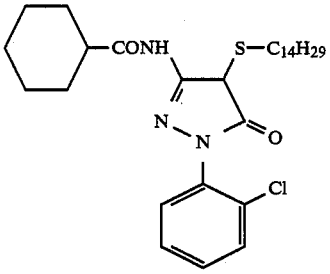
M - 3
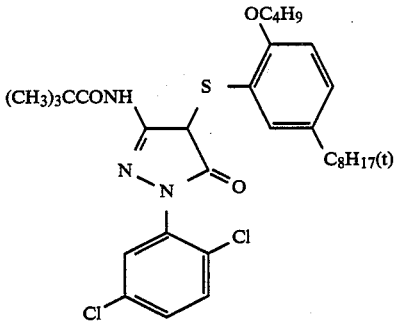
M - 4
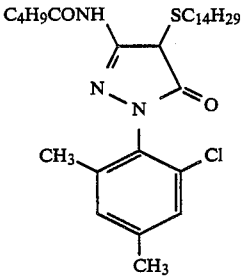
M - 5
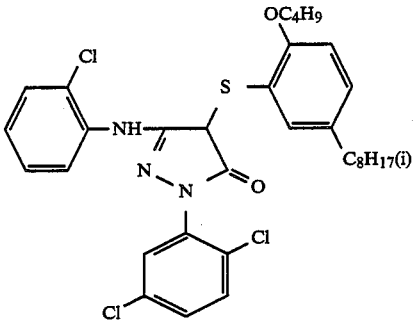
M - 6
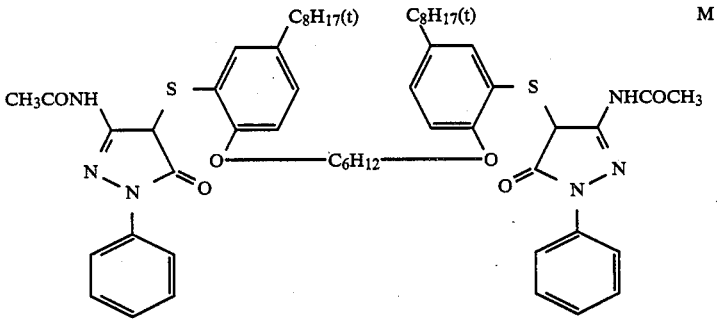

-continued
M - 7
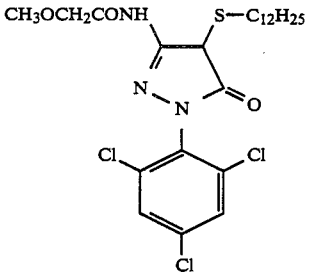
M - 8
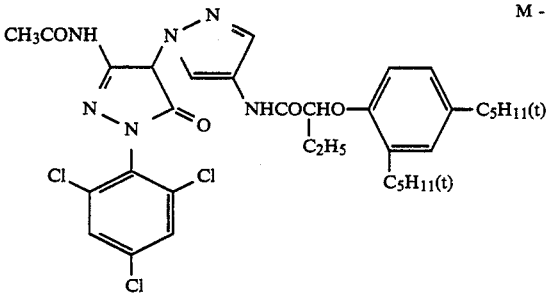
M - 9
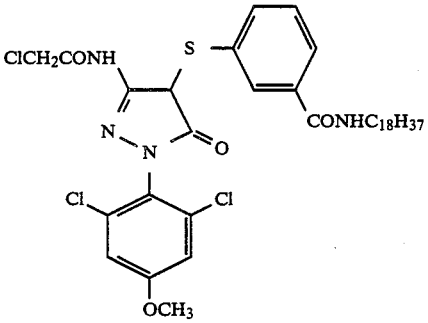
M - 10
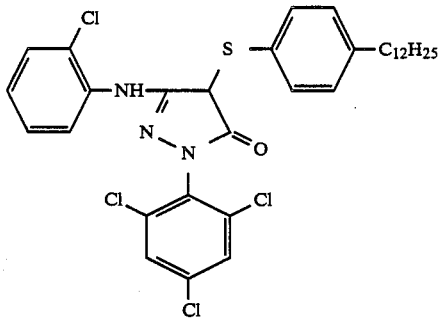
M - 11
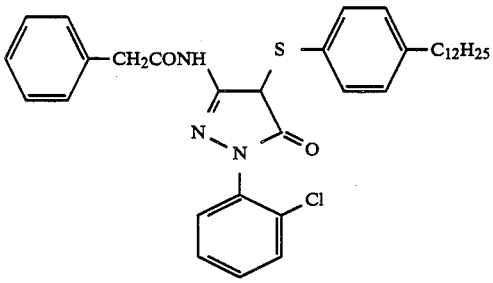
M - 12
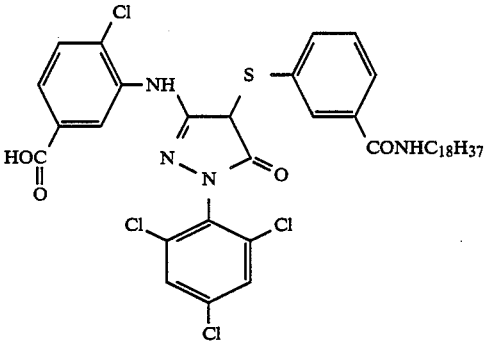
M - 13
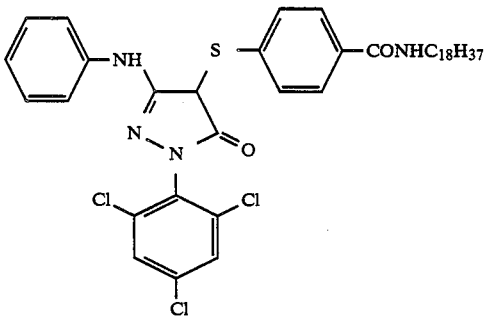
M - 14
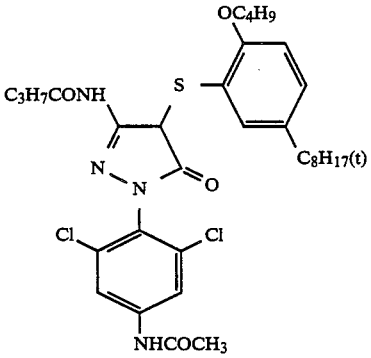

-continued
M - 15
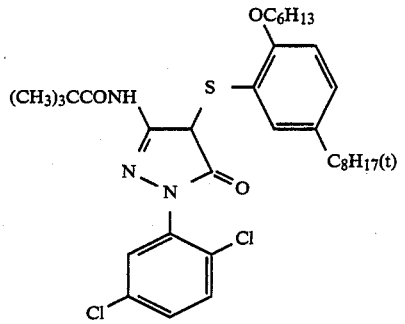
These compounds of this invention can be synthesized using the method described in U.S. Pat. Nos. 4,264,723, 3,227,554, 4,310,619 and 4,301,235, Japanese patent applications (OPI) Nos. 4044/82, 126833/81 and 122935/75, and so on.
C-1
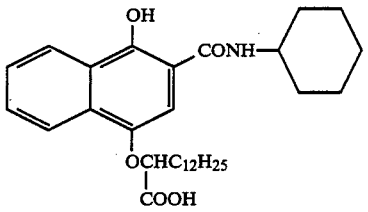
C-2
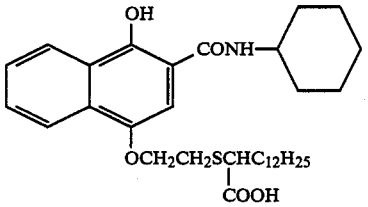
C-3
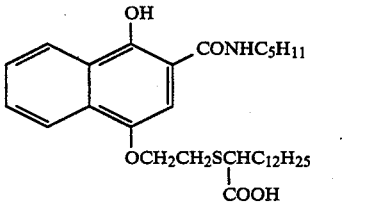
C-4
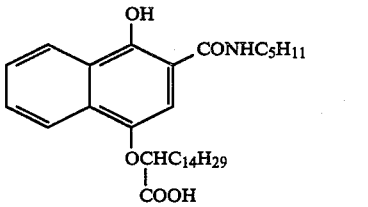
C-5
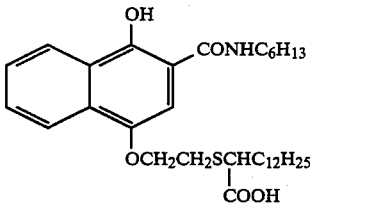
-continued
C-6
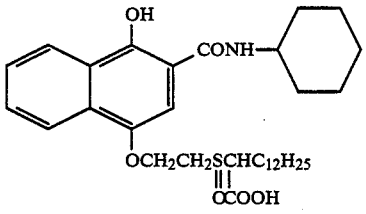
C-7
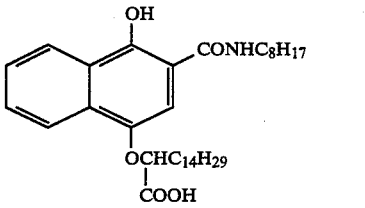
C-8
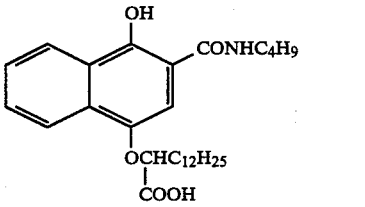
C-9
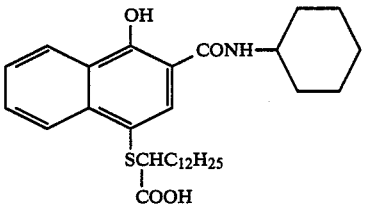
C-10
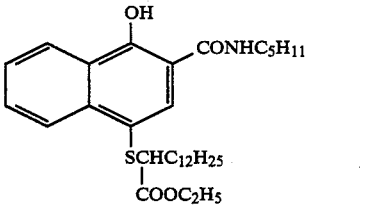

-continued

C-11

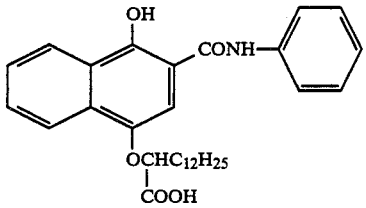

C-12

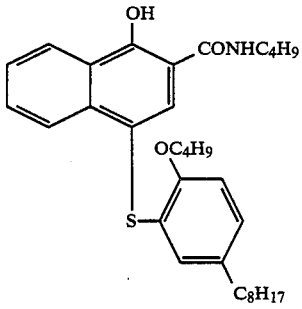

C-13

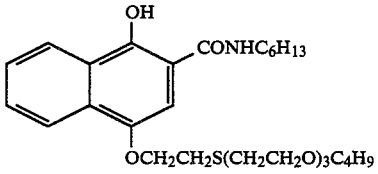

C-14

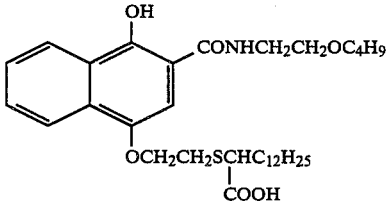

C-15

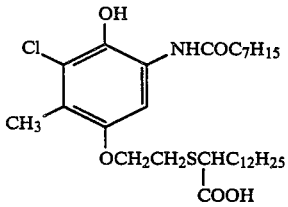

C-16

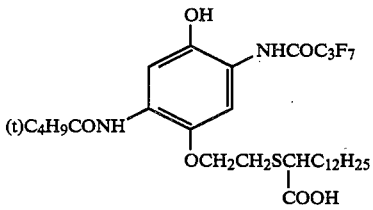

C-17

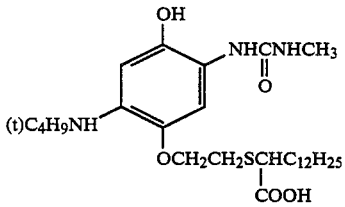

-continued

C-18

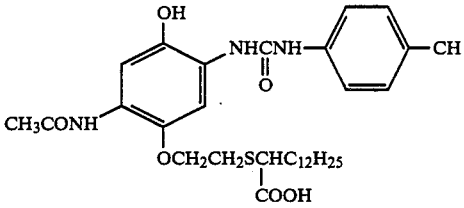

C-19

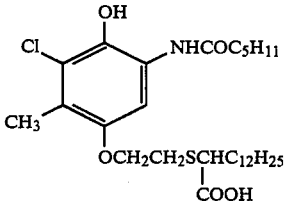

These compounds of this invention can be easily synthesized using the methods described in Japanese patent applications (OPI) Nos. 1938/81, 3934/82 and 105226/78; and so on.

The term of high reaction rate couplers, which are employed in this invention, is given to those which quickly undergo coupling reactions with couplers such as those represented by the following general formulae (CI) to (CV).

(CI)

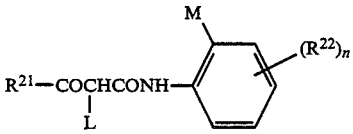

(CII)

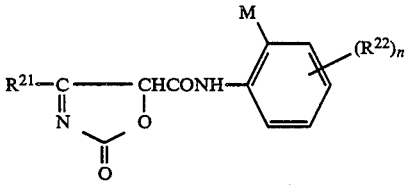

(CIII)

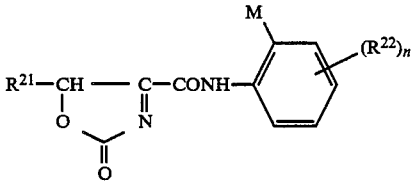

(CIV)

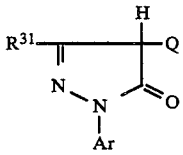

(CV)

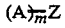

Among these couplers, couplers represented by the general formulae (CI), (CIV) and (CV) are more preferably used as the high reaction rate couplers.

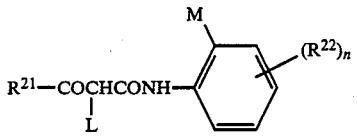

(CI)

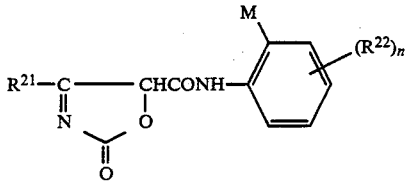

(CII)

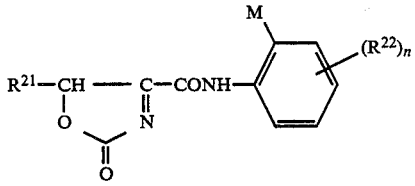

(CIII)

In the general formulae (CI), (CII), and (CIII) above, $R^{21}$ represents an alkyl group or an aryl group, each of which may be substituted; $R^{22}$ represents a substituent which can be substituted for a hydrogen atom attached to the benzene ring; and n represents 1 or 2. Therein, when n is 2, two $R^{22}$'s may be the same or different. M in the above-described formulae represents a halogen atom, an alkoxy group or an aryloxy group, and L therein represents a group capable of being released from the coupler upon the formation of a dye through the oxidative coupling with an aromatic primary amine developer.

More specifically, suitable examples of the alkyl group represented by $R^{21}$ include those which have 1 to 8 carbon atoms. Among these groups, those which have a branched chain, e.g., an isopropyl group, a tert-butyl group, a tert-amyl group and the like, are preferable. A tert-butyl group is particularly advantageous. Suitable examples of the aryl group represented by $R^{21}$ include phenyl and so on.

Substituents of the alkyl group and the aryl group represented by $R^{21}$ are not limited to any particular ones. However, specific examples include halogen atoms (e.g., fluorine, chlorine, bromine, iodine, etc.), alkyl groups (e.g., methyl, ethyl, t-butyl, etc.), aryl groups (e.g., phenyl, naphthyl, etc.), alkoxy groups (e.g., methoxy, ethoxy, etc.), aryloxy groups (e.g., phenoxy, etc.), alkylthio groups (e.g., methylthio, ethylthio, octylthio, etc.), arylthio groups (e.g., phenylthio, etc.), acylamino groups (e.g., acetamide, butyramide, benzamide, etc.), carbamoyl groups (e.g., N-methylcarbamoyl, N-phenylcarbamoyl, etc.), acyl groups (e.g., acetyl, benzoyl, etc.), sulfonamido groups (e.g., methanesulfonamide, benzenesulfonamide, etc.), a sulfamoyl group, a nitrile group, acyloxy groups (e.g., acetoxy, benzoxy, etc.), alkyloxycarbonyl groups (e.g., methyloxycarbonyl, etc.) and so on.

Specific examples of $R^{22}$ include halogen atoms (e.g., fluorine, chlorine, bromine, iodine, etc.), $R^{23}$,

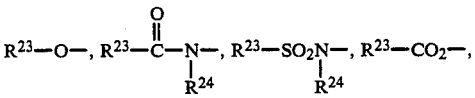

-continued

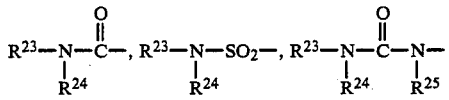

and so on. Therein, $R^{23}$, $R^{24}$ and $R^{25}$ may be the same or different, and they each represents a hydrogen atom, an alkyl group, an aryl group or a heterocyclic residue, which groups each may have a certain substituents. Preferable examples of them include alkyl groups and aryl groups which may have certain substituents. Specific examples of such substituents include the same groups as described in $R^{21}$.

Specific examples of the halogen atom represented by M include fluorine, chlorine, bromine and iodine. Among such atoms, fluorine and chlorine are more favorable. Suitable examples of the alkoxy group represented by M include those which contain 1 to 18 carbon atoms, e.g., methoxy, ethoxy, cetyloxy, etc. In such groups, methoxy is particularly suitable. Suitable examples of the aryloxy group represented by M include phenoxy and naphthyloxy.

Specific examples of the group represented by L include halogen atoms (e.g., fluorine, chlorine, bromine, etc.), —$SR^{26}$ groups [wherein $R^{26}$ represents an alkyl group (e.g., methyl, ethyl, ethoxyethyl, ethoxycarbonylmethyl, etc.), an aryl group (e.g., phenyl, 2-methoxyphenyl, etc.), a heterocyclic residue (e.g., benzoxazolyl, 1-phenyl-5-tetrazolyl, etc.) or an acyl group (e.g., ethoxycarbonyl, etc.)], —$OR^{27}$ groups [wherein $R^{27}$ represents an alkyl group (e.g., carboxymethyl, N-(2-methoxyethyl)carbamoylmethyl, etc.), an aryl group (e.g., phenyl, 4-carboxyphenyl, 4-(4-benzyloxybenzenesulfonyl)phenyl, etc.), a heterocyclic residue (e.g., 1-phenyl-5-tetrazolyl, isoxazolyl, 4-pyridyl, etc.) or an acyl group (e.g., ethoxycarbonyl, N,N-diethylcarbamoyl, phenylsulfamoyl, N-phenylthiocarbamoyl, etc.)] and

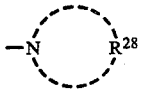

groups (wherein $R^{28}$ represents non-metal atoms necessary to form a 5- or 6-membered ring together with —N<, and constituent atoms of such a ring include C, N, O and/or S and, further, such a ring may have proper substituents).

Specific examples of the heterocyclic residue represented by

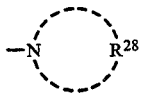

are illustrated below.

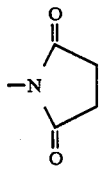

-continued
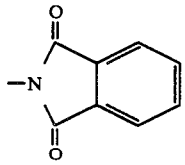
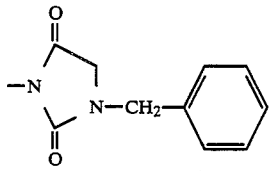
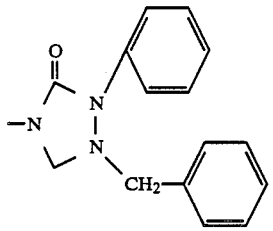
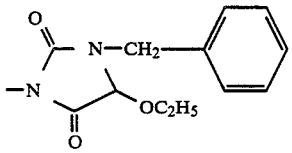
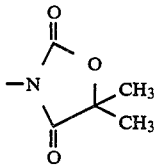
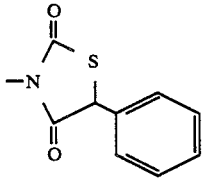
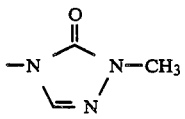
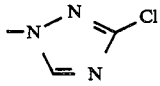
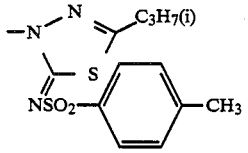
-continued
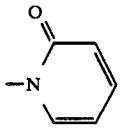
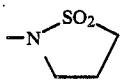
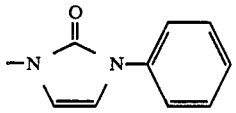
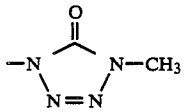
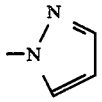
Specific examples of the high reaction rate couplers represented by the general formulae (CI) to (CIII) are illustrated below. However, the high reaction rate couplers of these types which can be employed in this invention should not be construed as being limited to the following examples.
CI-1
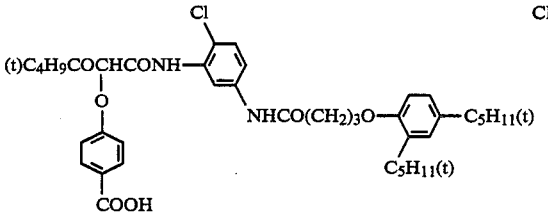
CI-2
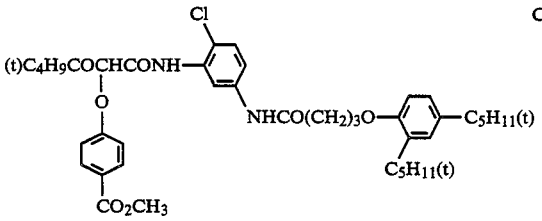
CI-3
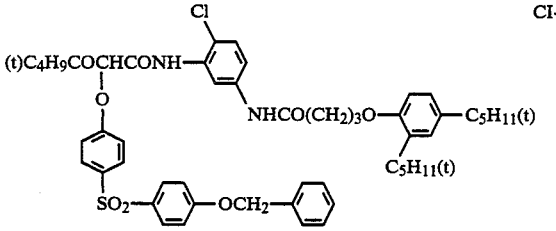

-continued
CI-4
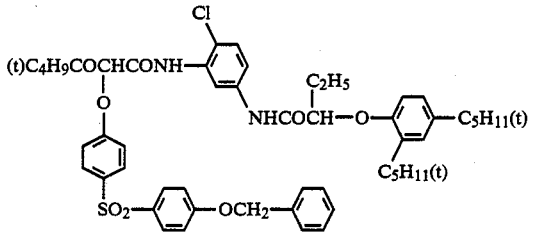
CI-5
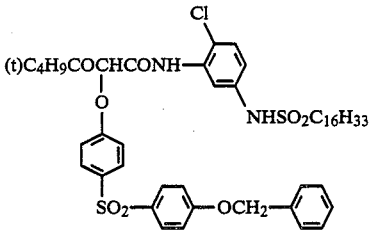
CI-6
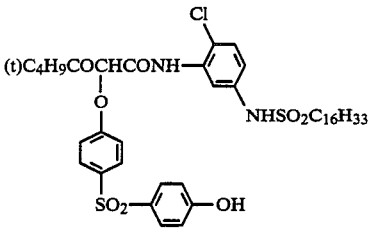
CI-7
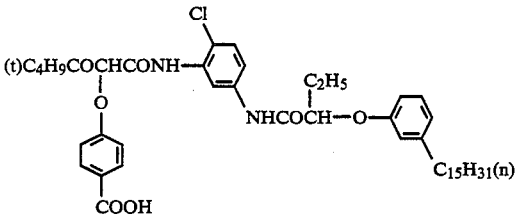
CI-8
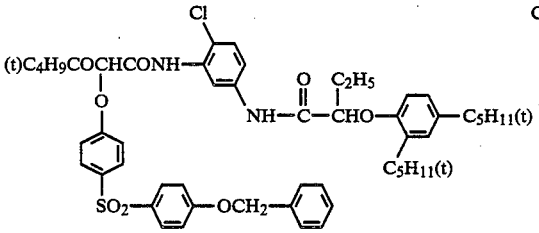
CI-9
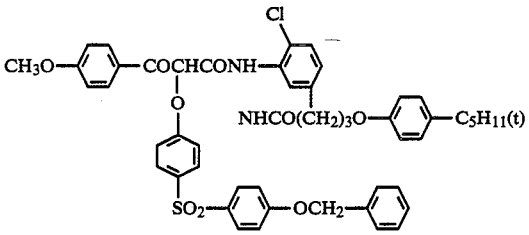
CI-10
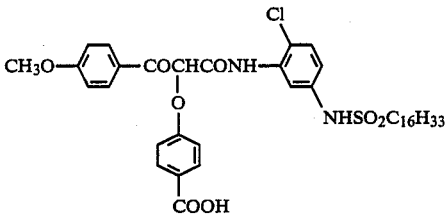
-continued
CI-11
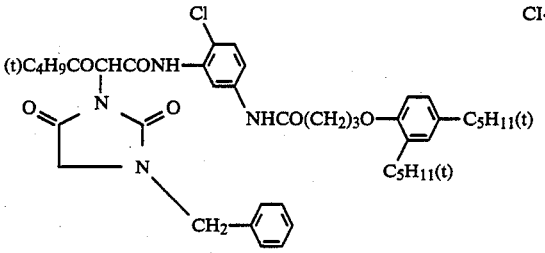
CI-12
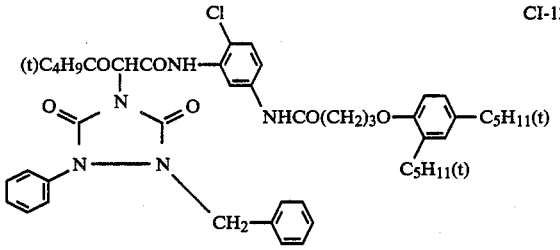
CI-13
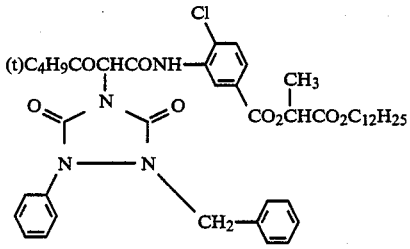
CI-14
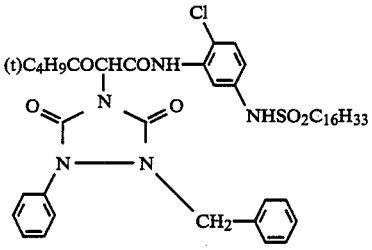
CI-15
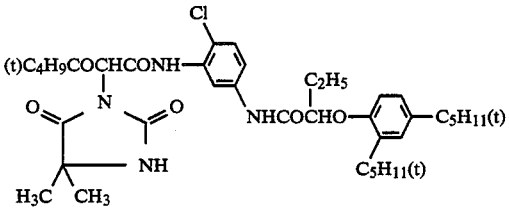
CI-16
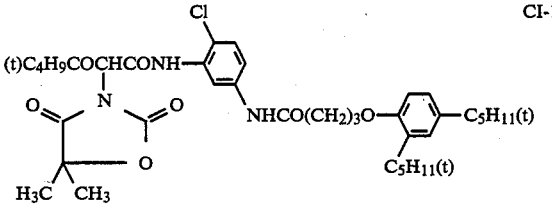

-continued
CI-17
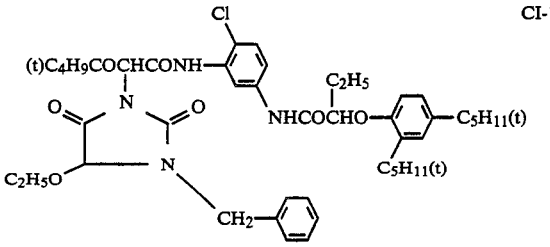
CI-18
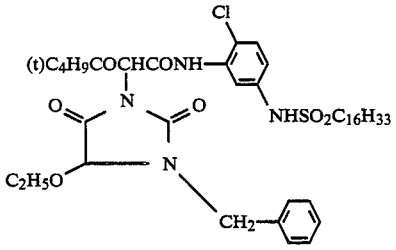
CI-19
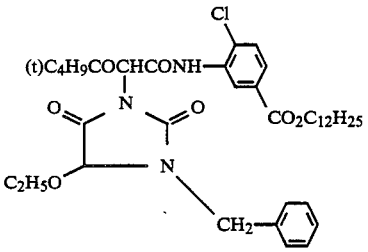
CI-20
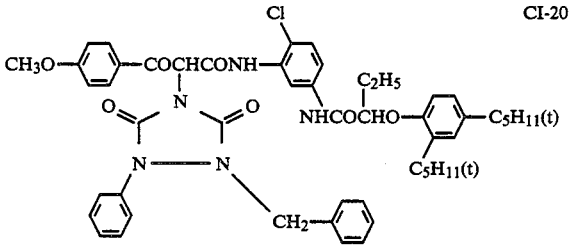
CI-21
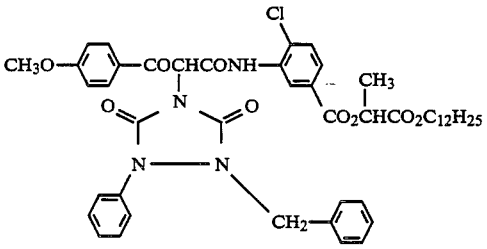
CI-22
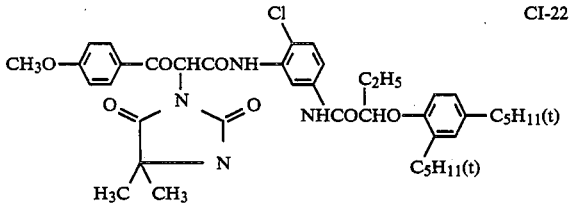
-continued
CI-23
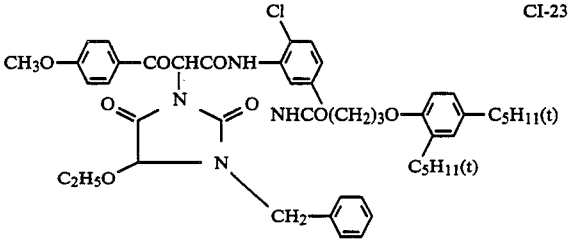
CI-24
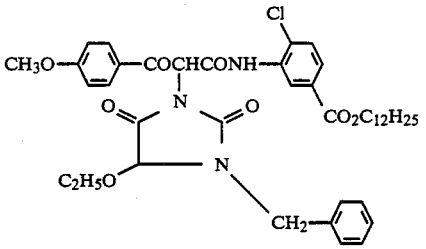
CI-25
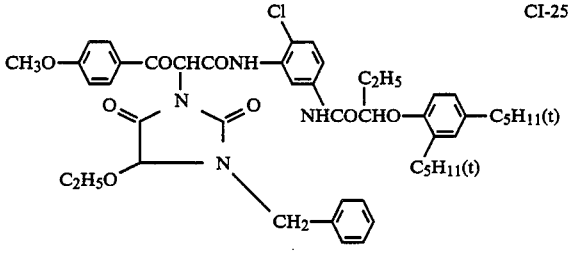
CI-26
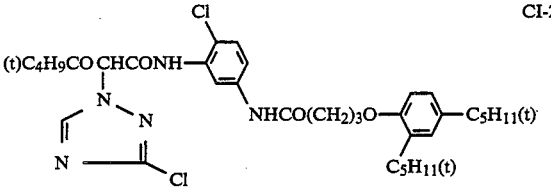
CI-27
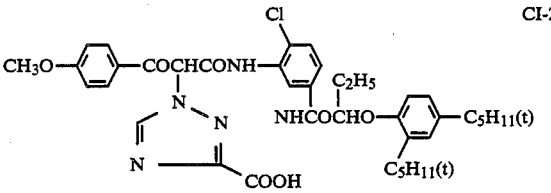
CI-28
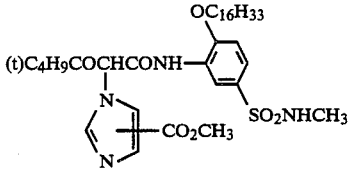
CI-29
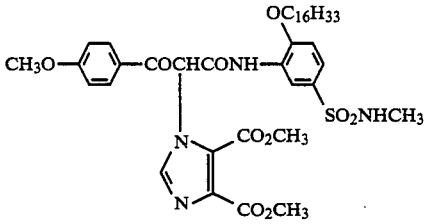

-continued
CI-30
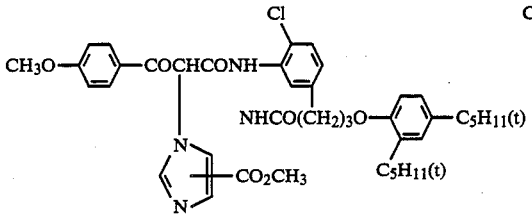
CI-31
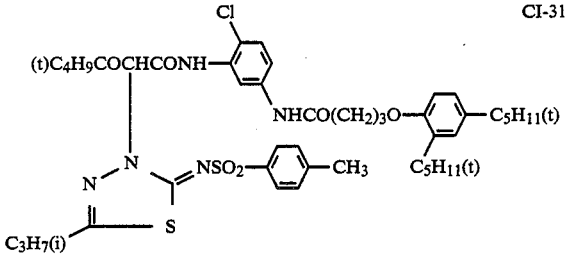
CI-32
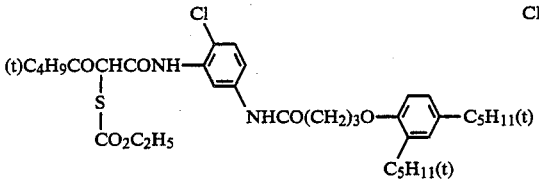
CI-33
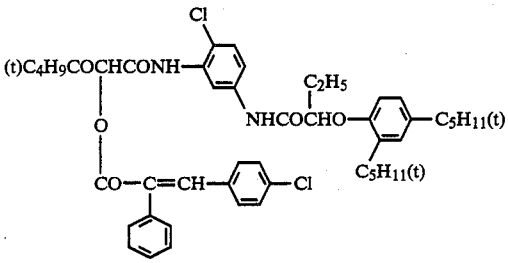
CI-34
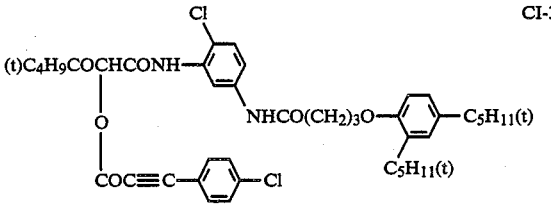
CI-35
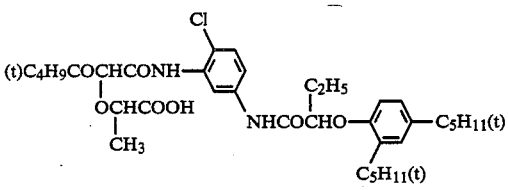
CI-36
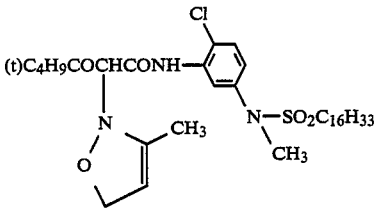
-continued
CI-37
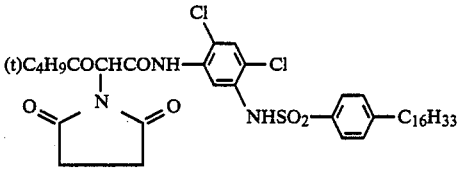
CI-38
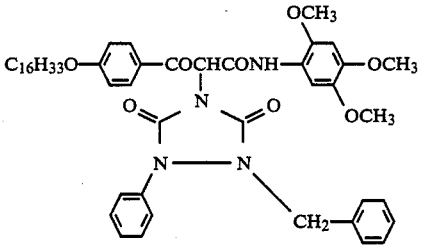
CI-39
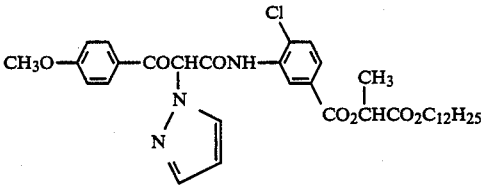
CII-1
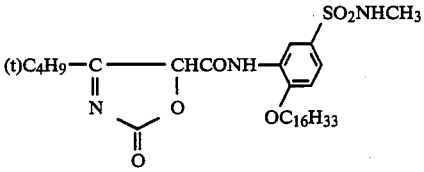
CII-2
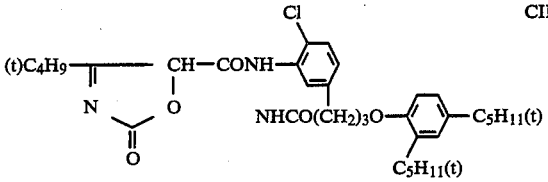
CII-3
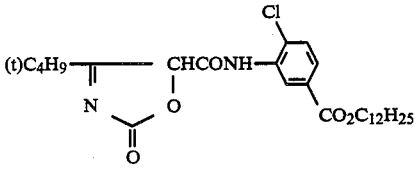
CII-4
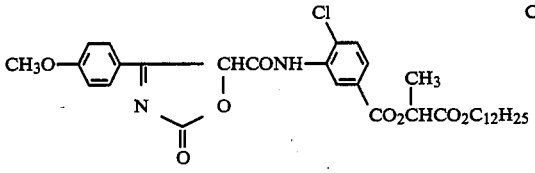
CIII-1
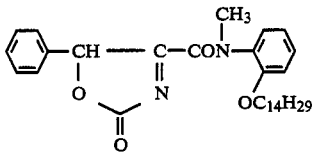

-continued

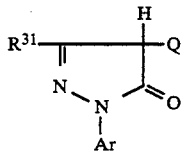

(CIV)

In the general formula (CIV) above, $R^{31}$ represents an amino group, an acylamino group or a ureido group; Q represents a group capable of being released from the coupler (CIV) upon the formation of a dye through the oxidative coupling with an aromatic primary amine developer; and Ar represents a phenyl group which may have one or more of a substituent, with specific examples of the substituent including halogen atoms, alkyl groups, alkoxy groups, aryloxy groups, alkoxycarbonyl groups, a cyano group, a carbamoyl group, a sulfamoyl group, a sulfonyl group and acylamino groups.

The substituent groups in the formula (CIV) are described in detail below.

Suitable examples of the amino group represented by $R^{31}$ include anilino, 2-chloroanilino, 2,4-dichloroanilino, 2,5-dichloroanilino, 2,4,5trichloroanilino, 2-chloro-5-tetradecanamidoanilino, 2-chloro-5-(3-octadecenylsuccinimido)anilino, 2-chloro-5-tetradecyloxycarbonylanilino, 2-chloro-5-(N-tetradecylsulfamoyl)anilino, 2,4-dichloro-5-tetradecyloxyanilino, 2-chloro-5-(tetradecyloxycarbonylamino)anilino, 2-chloro-5-octadecylthioanilino, 2-chloro-5-(N-tetradecylcarbamoyl)anilino, 2-chloro-5-[α-(3-tert-butyl-4-hydroxy)tetradecanamido]anilino, dimethylamino, diethylamino, dioctylamino, pyrrolidino and so on.

Suitable examples of the acylamino group represented by $R^{31}$ include acetamido, benzamido, 3-[α-(2,4-di-tert-amylphenoxy)butanamido]benzamido, 3-[α-(2,4-di-tert-amylphenoxy)acetamido]benzamido, 3-[α-(3-pentadecylphenoxy)butanamido]benzamido, α-(2,4-di-tert-amylphenoxy)butanamido, α-(3-pentadecylphenoxy)butanamido, hexadecanamido, isostearoylamino, 3-(3-octadecenylsuccinimido)benzamido, pivaloylamino and so on.

Suitable examples of the ureido group represented by $R^{31}$ include 3-[(2,4-di-tert-amylphenoxy)-acetamido]-phenylureido, phenylureido, methylureido, octadecylureido, 3-tetradecanamidophenylureido, N,N-dioctylureido and so on.

Specific examples of Q in the general formula (CIV) include halogen atoms (e.g., fluorine, chlorine, bromine, etc.), —SCN, —NCS, $R^{32}SO_2NH$—

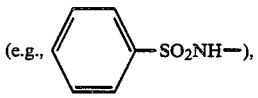

$R^{32}CONH$— (e.g., $CF_3CONH$—, $Cl_3CCONH$—, etc.), $R^{32}OCONH$— (e.g., $CH_3OCONH$—), $R^{32}O$-

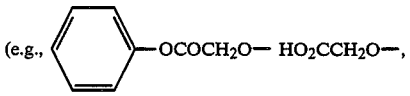

-continued

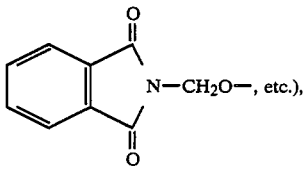

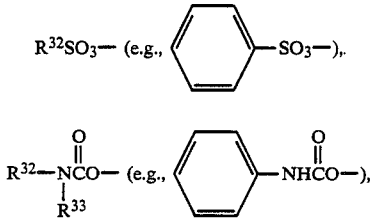

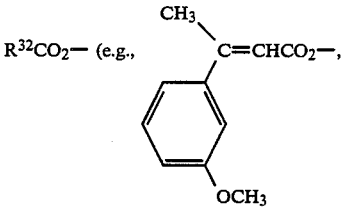

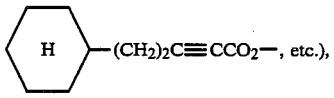

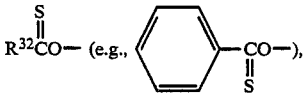

$R^{32}(COCO_2$— (e.g., $CH_3COCO_2$—),

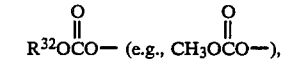

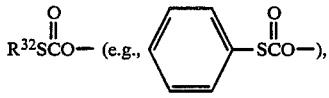

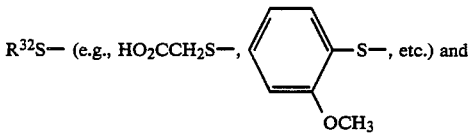

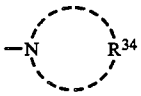

(wherein $R^{34}$ represents non-metal atoms necessary to form a 5- or 6-membered ring together with —N< and that, its constituent atoms include C, N, O and/or S, and which ring may have an appropriate substituent).

Suitable examples of the ring residue represented by

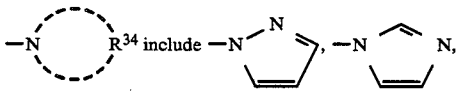

-continued

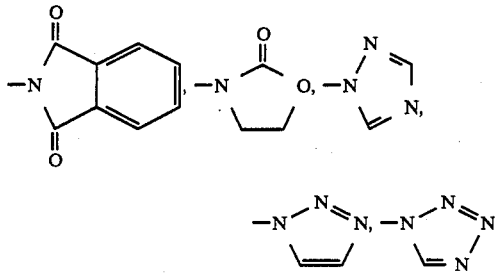

and so on. Suitable examples of the subtituent which may be attached to such ring residues include alkyl groups, alkenyl groups, alicyclic hydrocarbon residues, aralkyl groups, aryl groups, heterocyclic residues, alkoxy groups, alkoxycarbonyl groups, aryloxy groups, alkylthio groups, carboxy groups, acylamino groups, diacylamino groups, ureido groups, alkoxycarbonylamino groups, amino groups, acyl groups, a sulfonamido group, a carbamoyl group, a sulfamoyl group, a cyano group, acyloxy groups, a sulfonyl group, halogen atoms, a sulfo group and so on.

Therein, $R^{32}$ and $R^{33}$ may be either the same or different, and they each represents an aliphatic hydrocarbon, an aromatic hydrocarbon or a heterocyclic ring residue. $R^{32}$ and $R^{33}$ may have proper substituents, and $R^{32}$ may be a hydrogen atom.

The aliphatic hydrocarbon residue represented by $R^{32}$ or $R^{33}$ includes straight chain or branched chain alkyl groups, alkenyl groups, alkynyl groups and alicyclic hydrocarbon residues.

Specific examples of the alkyl group represented by $R^{32}$ or $R^{33}$ include those having 1 to 32, preferably 1 to 20, carbon atoms, such as methyl, ethyl, propyl, butyl, octyl, octadecyl, isopropyl and so on. Specific examples of the alkenyl group represented by $R^{32}$ or $R^{33}$ include those having 2 to 32, preferably 3 to 20, carbon atoms, such as allyl, butenyl and so on. Specific examples of the alkynyl group represented by $R^{32}$ or $R^{33}$ include those having 2 to 32, preferably 2 to 20, carbon atoms, such as ethynyl, propargyl and so on. Specific examples of the alicyclic hydrocarbon residue represented by $R^{32}$ or $R^{33}$ include those having 3 to 32, preferably 5 to 20, carbon atoms, such as cyclopentyl, cyclohexyl, 10-camphanyl and so on.

Specific examples of the aromatic hydrocarbon residue represented by $R^{32}$ or $R^{33}$ include a phenyl group, a naphthyl group and so on.

The heterocyclic group represented by $R^{32}$ or $R^{33}$ is a 5- or 6-membered ring residue which is constituted with carbon atoms and at least one or more hetero atoms selected from the group consisting of a nitrogen atom, an oxygen atom and a sulfur atom and, further, may be condensed with a benzene ring, with specific examples including pyridyl, pyrrolyl, pyrazolyl, triazolyl, triazolidyl, imidazolyl, tetrazolyl, thiazolyl, oxazolyl, thiadiazolyl, oxadiazolyl, quinolinyl, benzothiazolyl, benzoxazolyl, benzimidazolyl, benzotriazolyl and so on.

Specific examples of the substituents which the groups represented by $R^{32}$ or $R^{33}$ may have include alkyl groups (e.g., methyl, ethyl, t-octyl, etc.), aryl groups (e.g., phenyl, naphthyl, etc.), a nitro group, a hydroxyl group, a cyano group, a sulfo group, alkoxy groups (e.g., methoxy, ethoxy, butyloxy, methoxyethoxy, etc.), aryloxy groups (e.g., phenoxy, naphthyloxy, etc.), a carboxyl group, acyloxy groups (e.g., acetoxy, benzoxy, etc.), acylamino groups (e.g., acetylamino, benzoylamino, etc.), sulfonamido groups (e.g., methanesulfonamido, benzenesulfonamido, etc.), sulfamoyl groups (e.g., methylsulfamoyl, phenylsulfamoyl, etc.), halogen atoms (e.g., fluorine, chlorine, bromine, etc.), carbamoyl groups (e.g., N-methylcarbamoyl, N-2-methoxyethylcarba-2-moyl, N-phenylcarbamoyl, etc.), alkoxycarbonyl groups (e.g., methoxycarbonyl, ethoxycarbonyl, etc.), acyl groups (e.g., acetyl, benzoyl, etc.), sulfonyl groups (e.g., methylsulfonyl, phenylsulfonyl, etc.), sulfinyl groups (e.g., methylsulfinyl, phenylsulfinyl, etc.), heterocyclic groups (e.g., morpholino, pyrazolyl, triazolyl, tetrazolyl, imidazolyl, pyridyl, benzotriazolyl, benzimidazolyl, etc.), amino groups (e.g., non-substituted amino, methylamino, ethylamino, etc.), alkylthio groups (e.g., methylthio, ethylthio, carboxymethylthio, etc.), arylthio groups (e.g., phenylthio, etc.) and so on. These substituents may be further substituted with one of these substituents.

Specific examples of the high reaction rate coupler represented by the general formula (CIV) are illustrated below. However, the high reaction rate couplers of this type which can be employed in this invention should not be construed as being limited to the following examples.

CIV-1

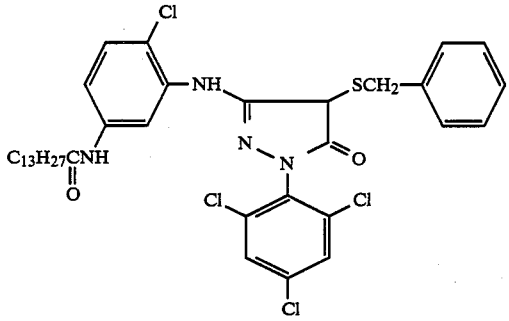

-continued
CIV-2
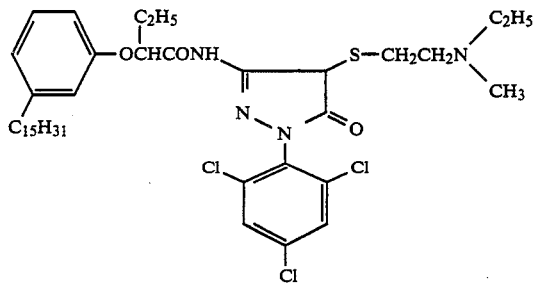
CIV-3
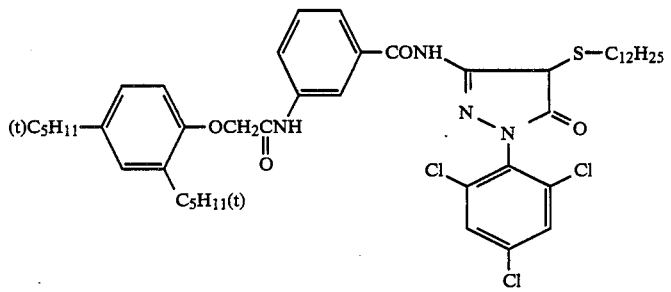
CIV-4
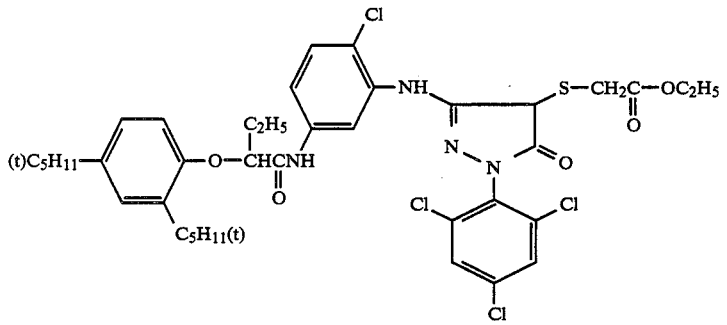
CIV-5
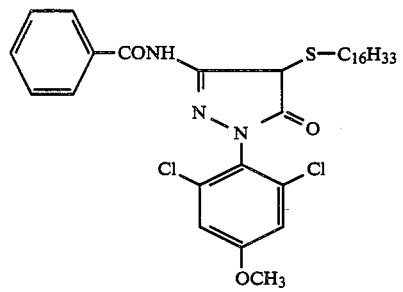
CIV-6
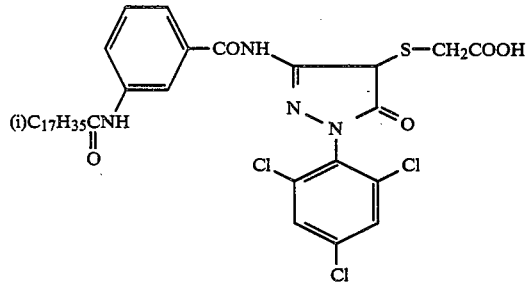

-continued
CIV-7
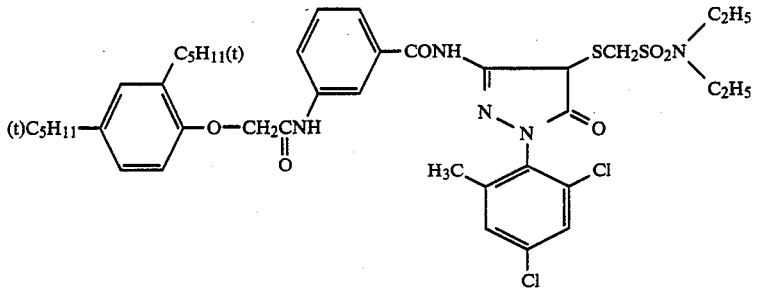
CIV-8
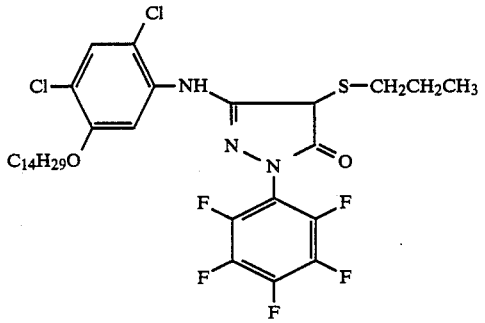
CIV-9
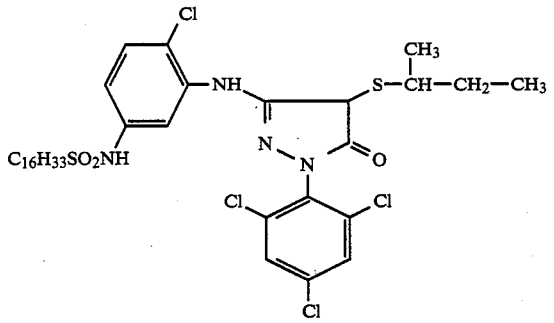
CIV-10
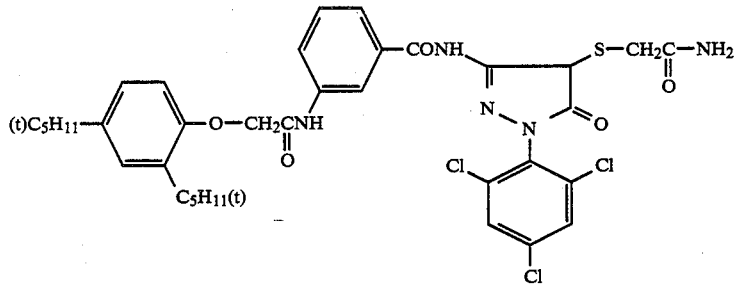
CIV-11
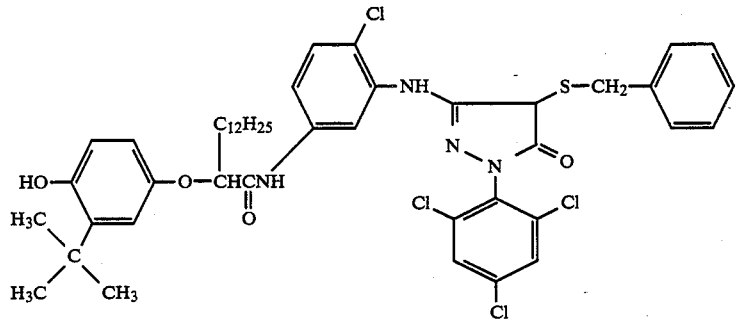

-continued
CIV-12
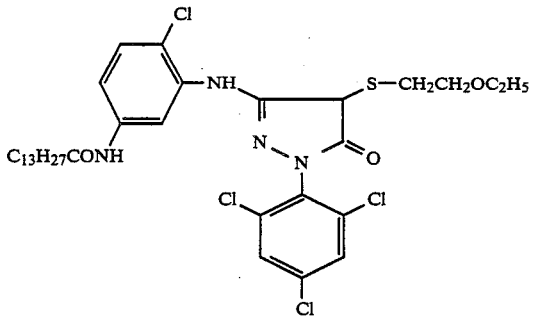
CIV-13
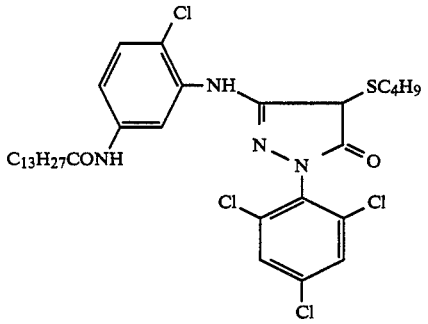
CIV-14
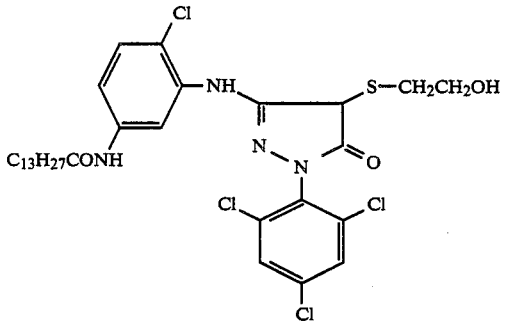
CIV-15
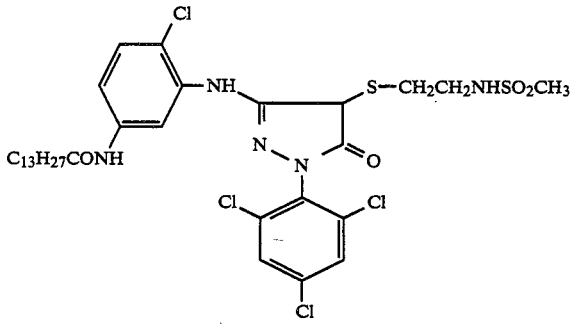
CIV-16
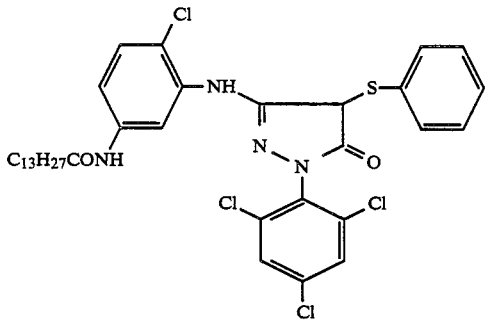

-continued
CIV-17
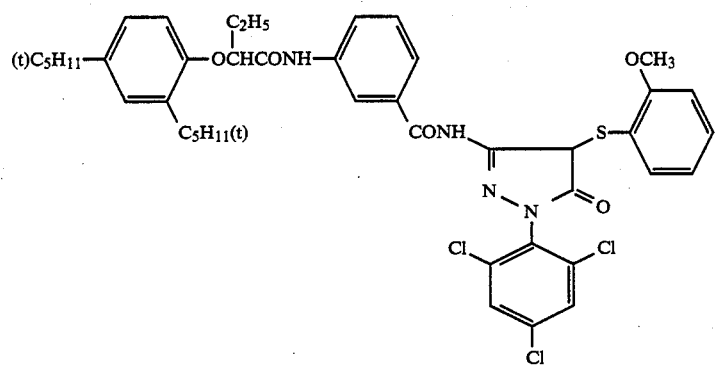
CIV-18
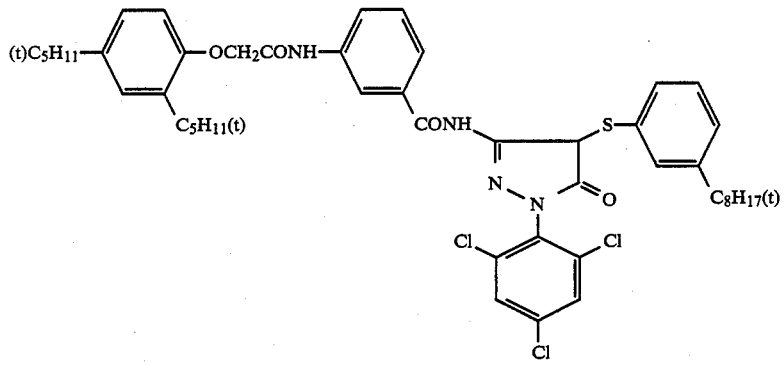
CIV-19
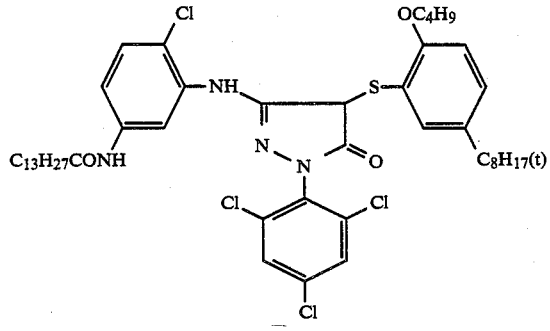
CIV-20
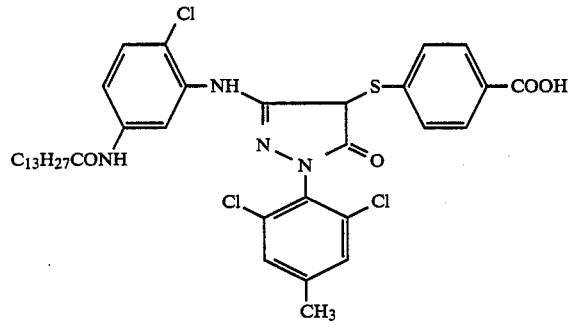

-continued
CIV-21
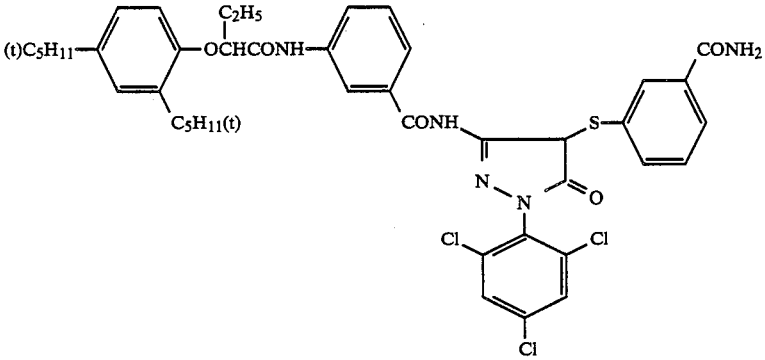
CIV-22
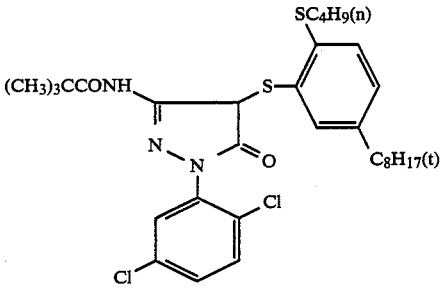
CIV-23
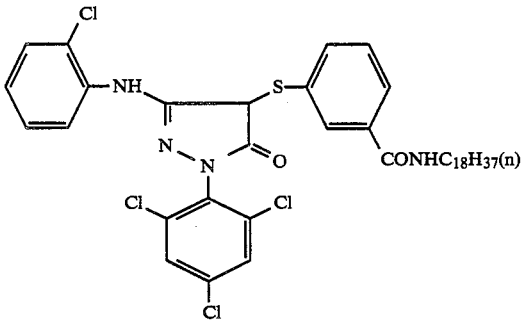
CIV-24
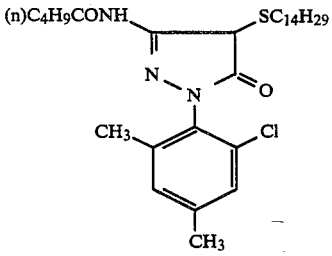
CIV-25
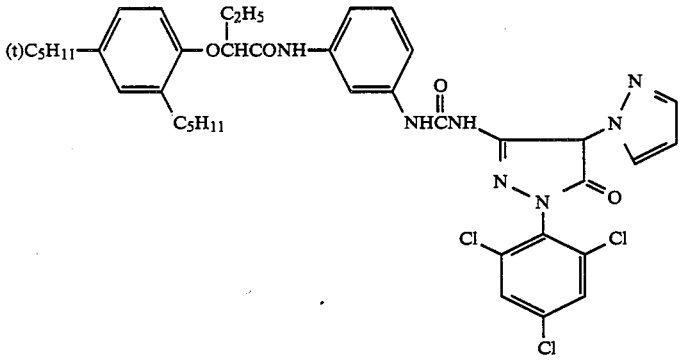

-continued
CIV-26
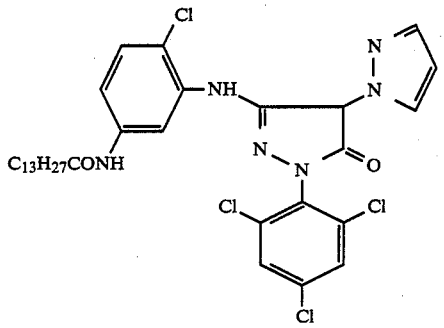
CIV-27
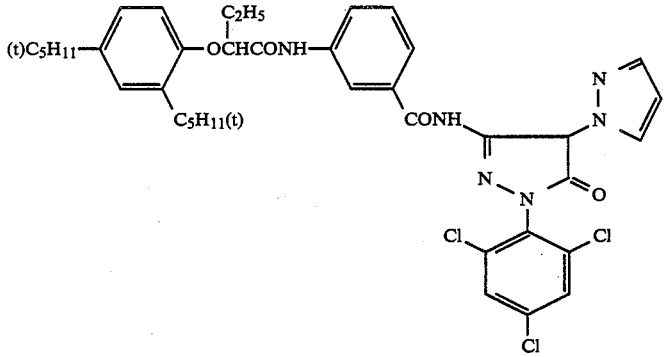
CIV-28
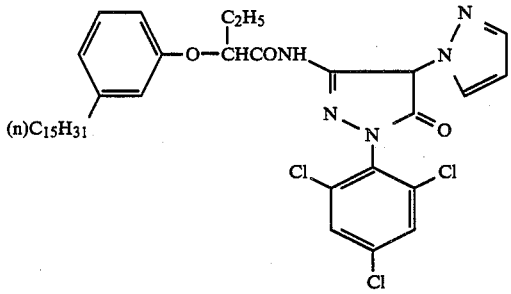
CIV-29
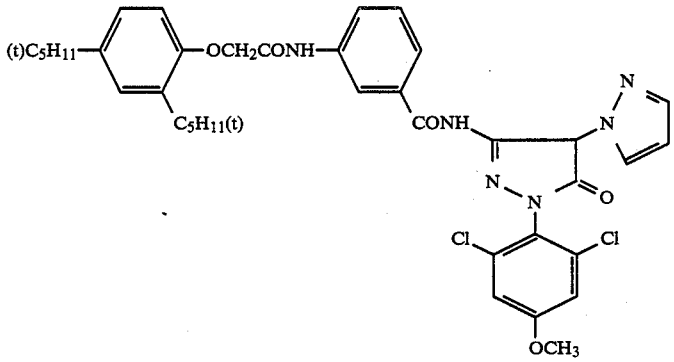

-continued
CIV-30
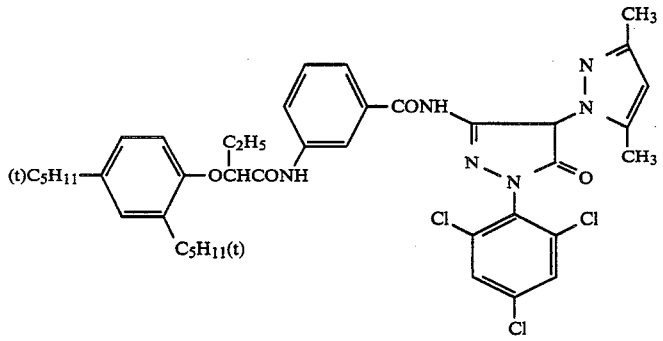
CIV-31
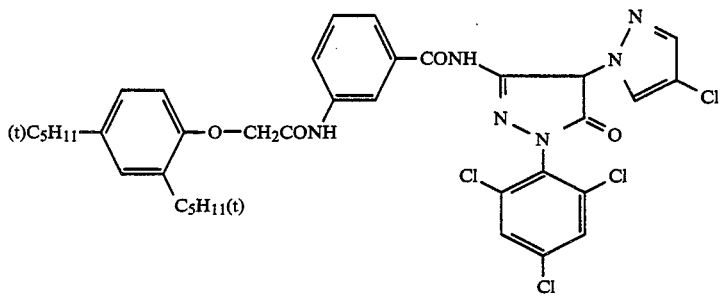
CIV-32
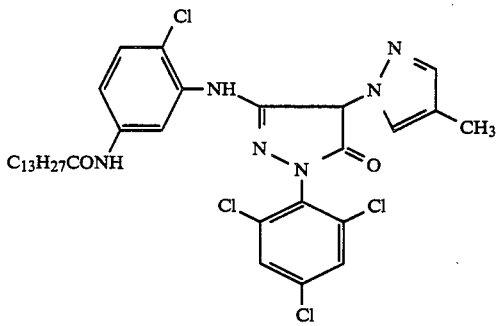
CIV-33
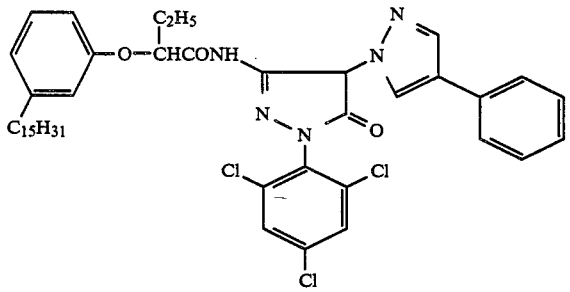
CIV-34
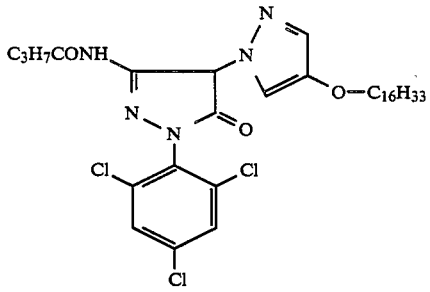

-continued
CIV-35
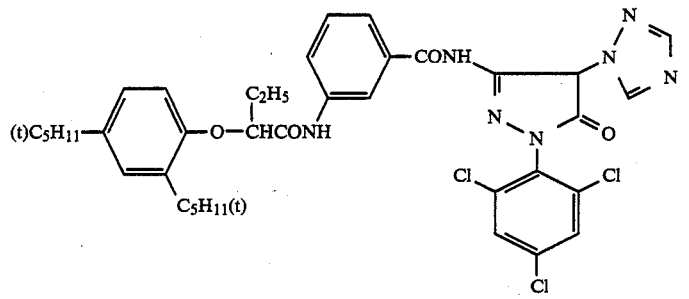
CIV-36
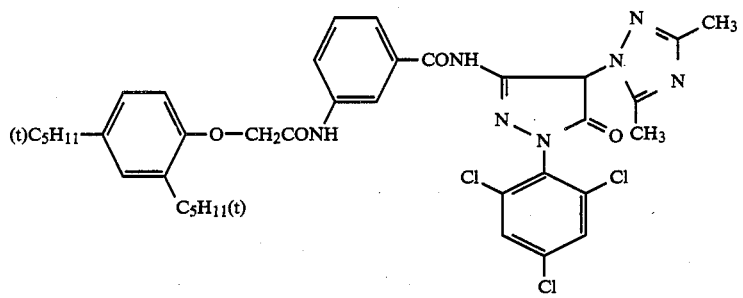
CIV-37
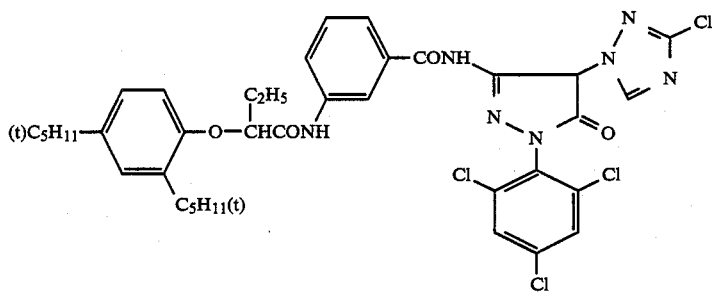
CIV-38
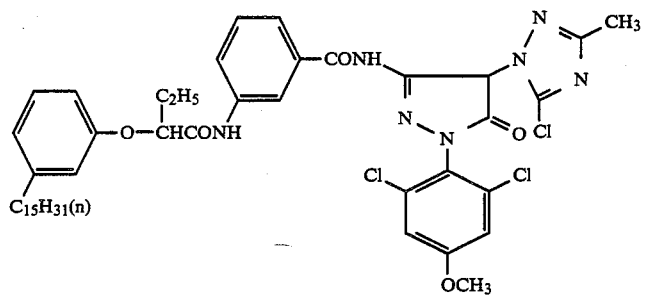
CIV-39
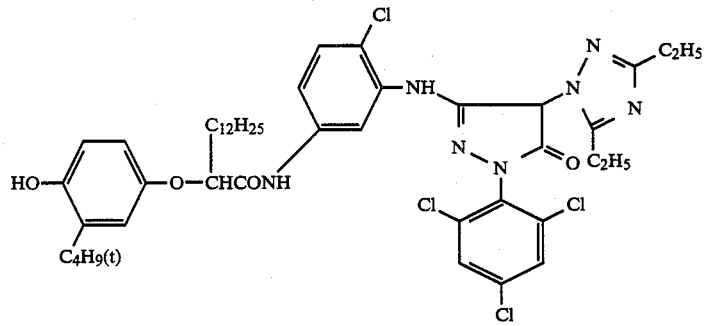

-continued
CIV-40
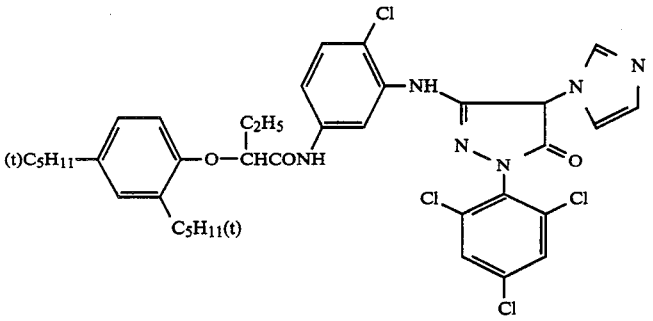
CIV-41
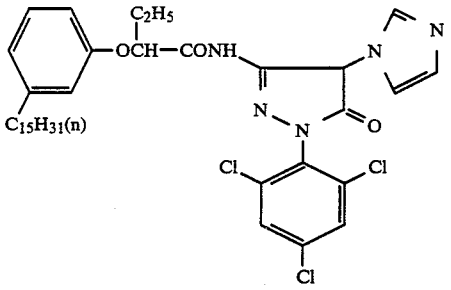
CIV-42
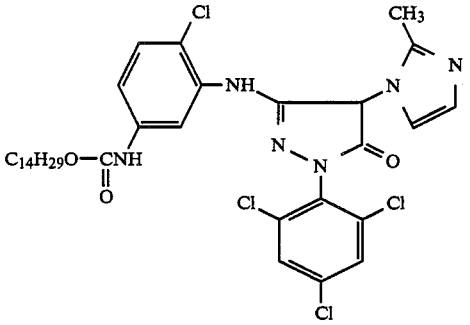
CIV-43
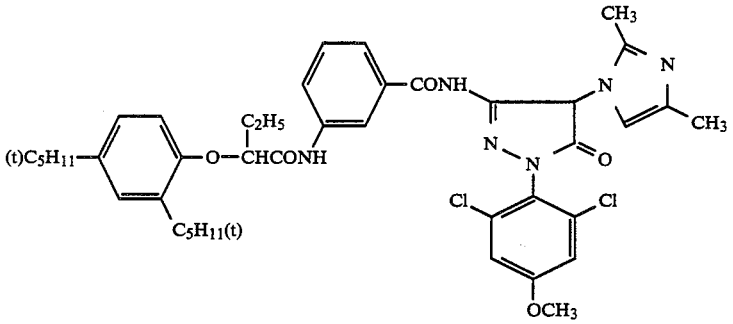
CIV-44
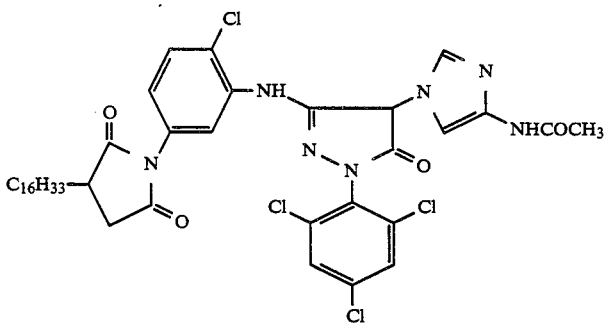

-continued
CIV-45
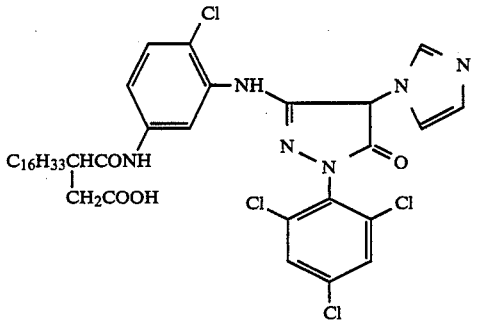
CIV-46
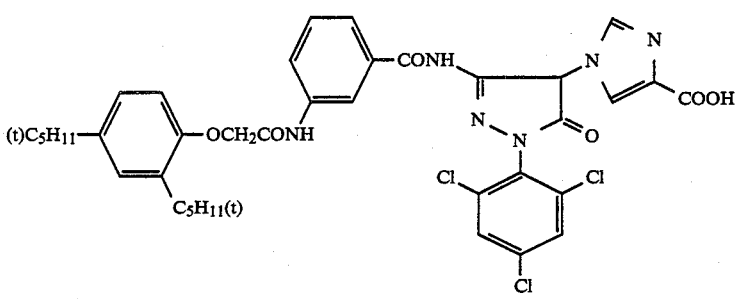
CIV-47
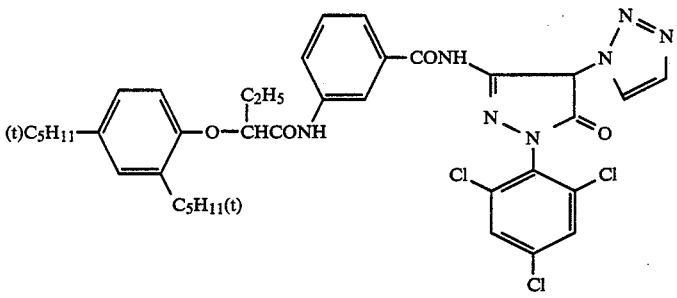
CIV-48
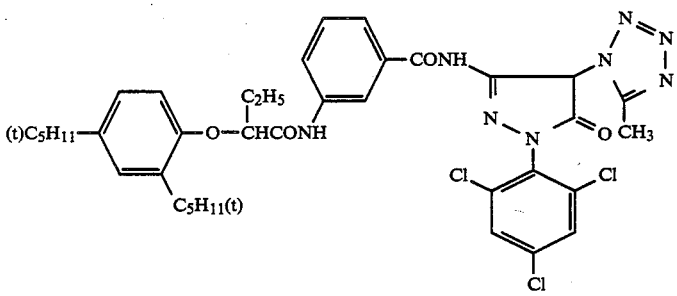
CIV-49
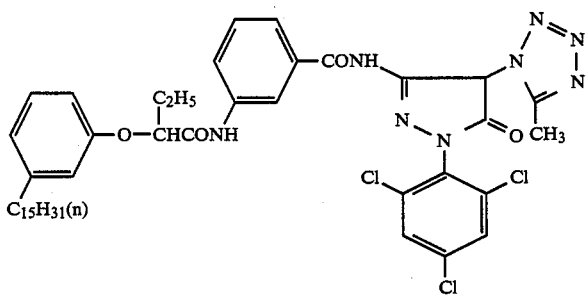

-continued
CIV-50
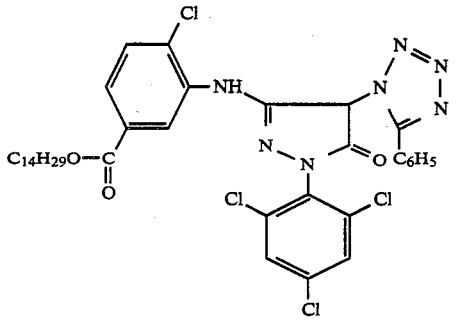
CIV-51
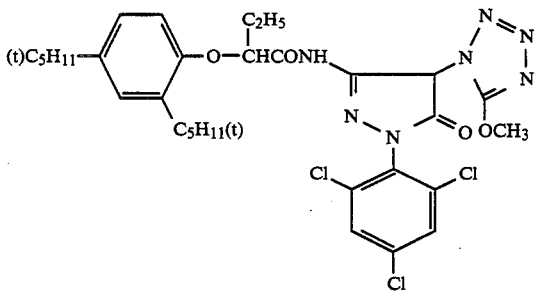
CIV-52
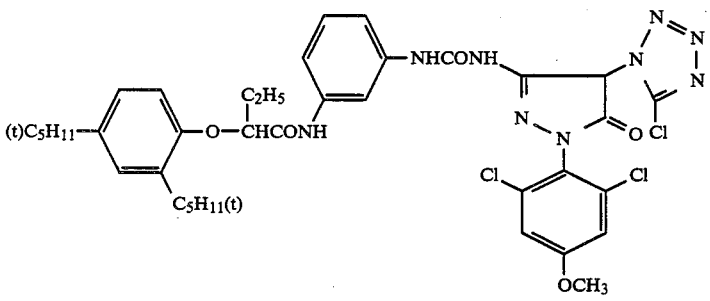
CIV-53
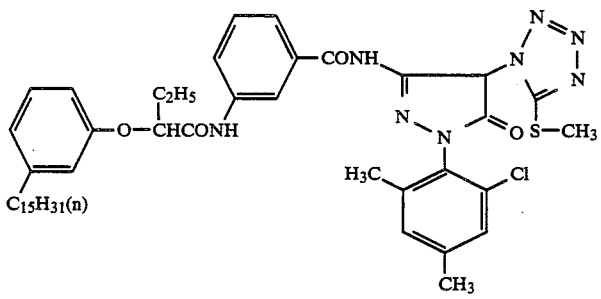
CIV-54
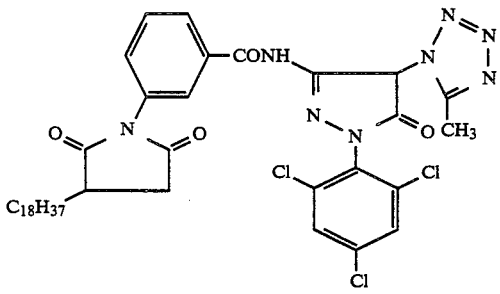

-continued
CIV-55
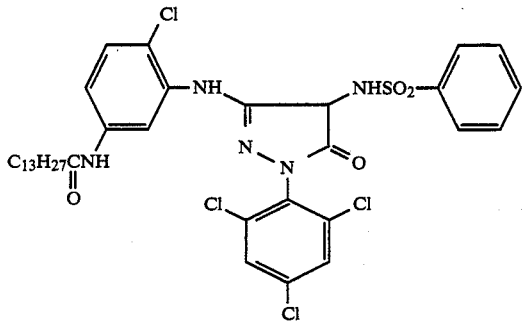
CIV-56
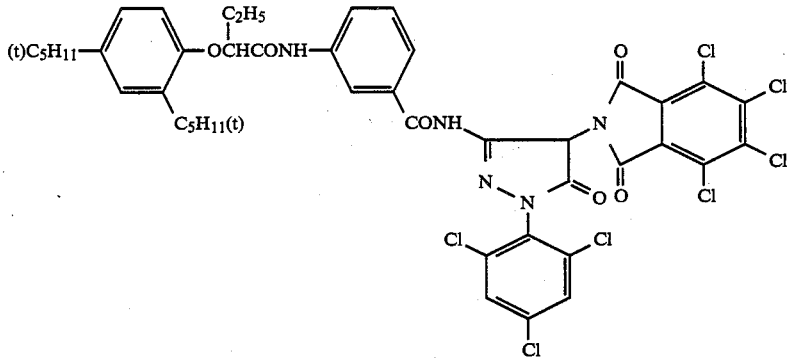
CIV-57
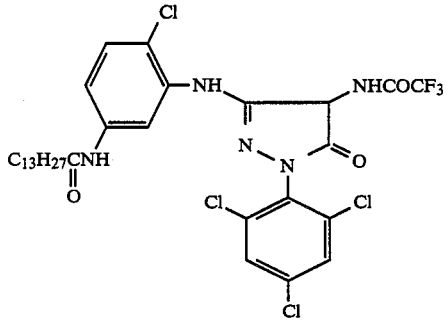
CIV-58
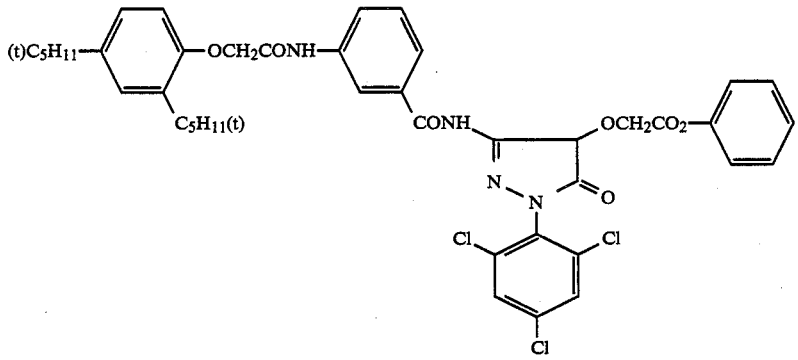

-continued
CIV-59
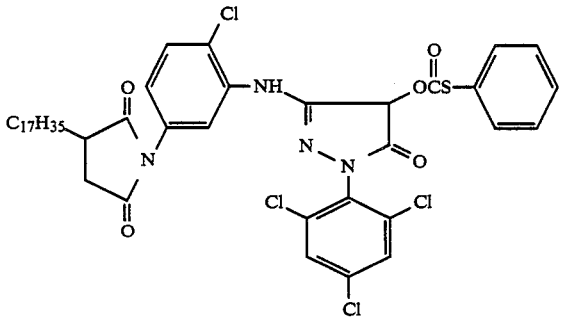
CIV-60
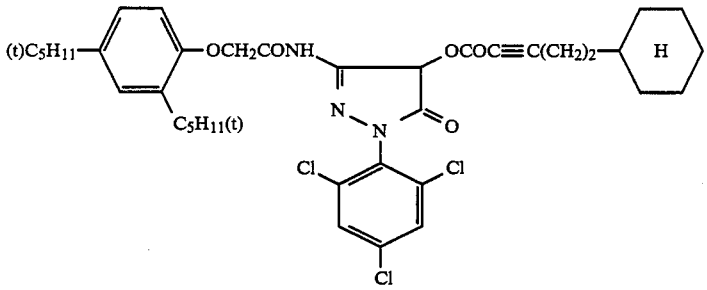
CIV-61
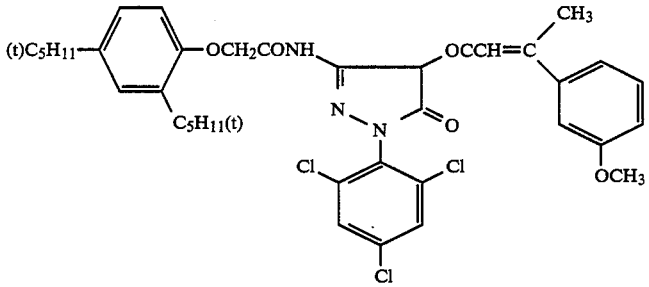
CIV-62
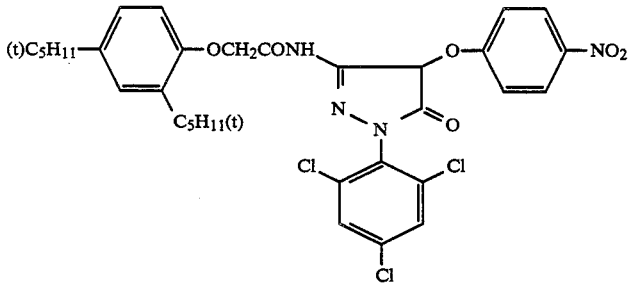
CIV-63
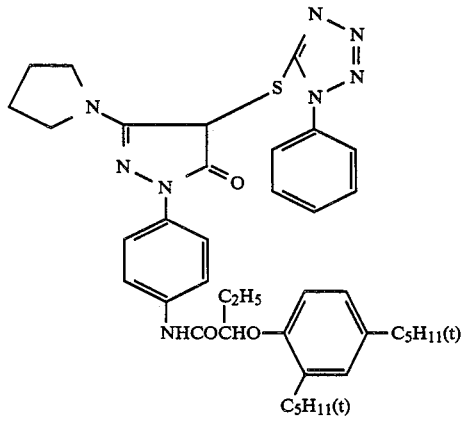

-continued $(A)_m$—Z (CV)

In the general formula (CV) above, A represents an image forming coupler residue which has a naphthol or a phenol nucleus, m represents 1 or 2, and Z represents a group which is attached to the coupling site of the above-described coupler residue and released from the coupler (CV) when a dye is formed through the oxidative coupling reaction with an aromatic primary amine developer, with specific examples including halogen atoms (e.g., F, Cl, etc.), —SCN, —NCS, —$NHSO_2R^{41}$, —$NHCOR^{41}$,

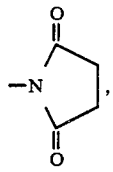

—$OR^{41}$, —$OSO_2R^{41}$, —$OCONR^{41}R^{42}$, —$OCOR^{41}$, —$OCSR^{41}$, —OCOCO-$R^{41}$, —$OCSNR^{41}R^{42}$, —O-$COOR^{41}$, —$OCOSR^{41}$ and —$SR^{41}$. Therein, when m represents 2, Z represents the divalent group corresponding to one of the above-described monovalent groups. $R^{41}$ and $R^{42}$ therein (which may be the same or different), respectively, represent aliphatic groups, aromatic groups and heterocyclic groups, which each may have a proper substituent. $R^{42}$ may represent a hydrogen atom.

Suitable examples of the aliphatic groups represented by $R^{41}$ or $R^{42}$ include straight or branched chain alkyl groups, alkenyl groups, alkynyl groups and alicyclic hydrocarbon residues.

Specific examples of the alkyl groups represented by $R^{41}$ or $R^{42}$ include those having 1 to 32, preferably 1 to 20, carbon atoms, such as methyl, ethyl, propyl, butyl, octyl, octadecyl, isopropyl, etc. Specific examples of the alkenyl group represented by $R^{41}$ or $R^{42}$ include those having 2 to 32, preferably 3 to 20, carbon atoms, such as allyl, butenyl, etc. Specific examples of the alkynyl group represented by $R^{41}$ or $R^{42}$ include those having 2 to 32, preferably 2 to 20, carbon atoms, such as ethynyl, propargyl, etc. Specific examples of the alicyclic hydrocarbon residue represented by $R^{41}$ or $R^{42}$ include those having 3 to 32, preferably 5 to 20, carbon atoms, such as cyclopentyl, cyclohexyl 10-camphanyl, etc.

Specific examples of the aromatic group represented by $R^{41}$ or $R^{42}$ include phenyl, naphthyl and the like.

The heterocyclic group represented by $R^{41}$ or $R^{42}$ is a 5- or 6-membered ring residue which is constituted with carbon atoms and at least one hetero atom selected from the group consisting of a nitrogen atom, an oxygen atom and a sulfur atom, and may be condensed with a benzene ring, with specifie examples including pyridyl, pyrrolyl, pyrazolyl, triazolyl, triazolidyl, imidazolyl, tetrazolyl, thiazolyl, oxazolyl, thiadiazolyl, oxadiazolyl, quinolinyl, benzothiazolyl, benzoxazolyl, benzimidazolyl and so on.

Suitable examples of a substituent which the group represented by $R^{41}$ or $R^{42}$ may have include aryl groups (e.g., phenyl, naphthyl, etc.), a nitro group, a hydroxyl group, a cyano group, a sulfo group, alkoxy groups (e.g., methoxy, ethoxy, methoxyethoxy, etc.), aryloxy groups (e.g., phenoxy, naphthyloxy, etc.), a carboxyl group, acyloxy groups (e.g., acetoxy, benzoxy, etc.), acylamino groups (e.g., acetylamino, benzoylamino, etc.), sulfonamido groups (e.g., methanesulfonamido, benzenenesulfonamido, etc.), sulfamoyl groups (e.g., methylsulfamoyl, phenylsulfamoyl, etc.), halogen atoms (e.g., fluorine, chlorine, bromine, etc.), carbamoyl groups (e.g., N-methylcarbamoyl, N-2-methoxyethylcarba-2-moyl, N-phenylcarbamoyl, etc.), alkoxycarbonyl groups (e.g., methoxycarbonyl, ethoxycarbonyl, etc.), acyl groups (e.g., acetyl, benzoyl, etc.), sulfonyl groups (e.g., methylsulfonyl, phenylsulfonyl, etc.), sulfinyl groups (e.g., methylsulfinyl, phenylsulfinyl, etc.), heterocyclic groups (e.g., morpholino, pyrazolyl, triazolyl, tetrazolyl, imidazolyl, pyridyl, benzotriazolyl, benzimidazolyl, etc.), amino groups (e.g., non-substituted amino, methylamino, ethylamino, etc.), alkylthio groups (e.g., methylthio, ethylthio, carboxymethylthio, etc.) and arylthio groups (e.g., phenylthio, etc.). These substituents each may be further substituted with one of the above-described substituents.

Among the couplers represented by the general formula (CV), those which are represented by the following general formula (CVI) are used to greater advantage.

$(R^{43}\text{-}A^1)_m Z$ (CVI)

wherein m represents 1 or 2, $A^1$ represents a cyan image forming coupler residue having a phenol nucleus or a cyan image forming coupler residue having an α-naphthol nucleus, and Z represents a group which is attached to the coupling site of the above-described coupler residue and that, released therefrom when the cyan dye is formed through the oxidative coupling reaction with an aromatic primary amine developer, that is, the group having the same meaning as described in the general formula (CV).

Suitable examples of $R^{43}$ in the general formula (CVI) include a hydrogen atom; alkyl groups having 30 or less, preferably 1 to 20, carbon atoms, especially methyl, isopropyl, pentadecyl, eicosyl and so on; alkoxy groups having 30 or less, preferably 1 to 20, carbon atoms, especially methoxy, isopropoxy, pentadecyloxy and eicosyloxy; aryloxy groups such as phenoxy and p-tert-butylphenoxy; acylamino groups represented by the following general formulae (A) to (D), respectively; and carbamyl groups represented by the following general formulae (E) and (F), respectively.

—NH—CO—L (A)

—NH—$SO_2$—L (B)

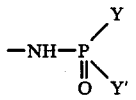

(C)

—NHCONH—L (D)

—CONHL (E)

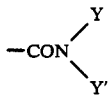

(F)

wherein L represents a straight or a branched chain alkyl group having 1 to 32, preferably 1 to 20, carbon atoms, a cyclic alkyl group (e.g., cyclopropyl, cyclohexyl, norbornyl, etc.) or an aryl group (e.g., phenyl, naphthyl, etc.). The above-described alkyl group and aryl group each may be substituted with a halogen atom, a nitro group, a cyano group, a hydroxyl group, a carboxy group, an amino group (e.g., amino, alkylamino, dialkylamino, anilino, N-alkylanilino, etc.), an aryl group, an alkoxycarbonyl group, an acyloxycarbonyl group, an amino group (e.g., acetamido, methanesulfonamido, etc.), an imido group (e.g., succinimido, etc.), a carbamoyl group (e.g., N,N-dihexylcarbamoyl, etc.), a sulfamoyl group (e.g., N,N-diethylsulfamoyl, etc.), an alkoxy group (e.g., ethoxy, octadecyloxy, etc.), an aryloxy group (e.g., phenoxy, p-tert-butylphenoxy, 4-hydroxy-3-tert-butylphenoxy, etc.) and so on. Y and Y' each represents a group selected from the class consisting of the above-described L, —OL,—NH—L and —$NL_2$. $R^{43}$ may be substituted with a conventionally used substituent in addition to the above-described substituents.

Among the compounds represents by the above-described general formula (CVI), particularly preferable ones are represented by the following general formula (CVII) or (CVIII):

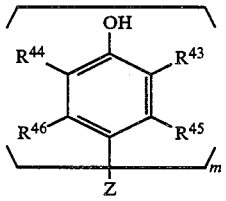

(CVII)

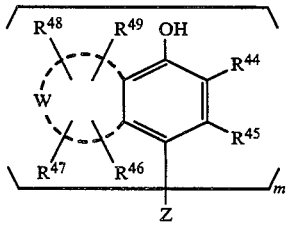

(CVIII)

wherein m, Z and $R^{43}$ have the same meanings as those in the general formula (CVI), respectively.

$R^{44}$ represents a hydrogen atom, an alkyl group containing 30 or less, preferably 1 to 20, of carbon atoms, or a carbamoyl group selected from those which are represented by the general formula (E) or (F), which are described as suitable examples of $R^{43}$ in the general formula (CVI).

$R^{45}$, $R^{46}$, $R^{47}$, $R^{48}$ and $R^{49}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group.

W represents non-metal atoms necessary to form a 5- or 6-membered ring by fusing with the benzene ring.

More specifically, suitable examples of $R^{45}$ include a hydrogen atom; primary, secondary and tertiary alkyl groups containing 1 to 22 carbon atoms, such as methyl, propyl, isopropyl, n-butyl, sec-butyl, tertbutyl, hexyl, dodecyl, 2-chlorobutyl, 2-hydroxyethyl, 2-phenylethyl, 2-(2,4,5-trichlorophenyl)ethyl, 2-amino-ethyl, etc.; aryl groups, such as phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl, 3-ethylnaphthyl, etc.; and heterocyclic groups, such as benzofuranyl, furanyl, thiazolyl, benzothiazolyl, naphthothiazolyl, oxazolyl, benzoxazolyl, naphthoxazolyl, pyridyl, quinolinyl, etc. Further, $R^{45}$ may also represent an amino group, such as amino, methylamino, diethylamino, dodecylamino, phenylamino, tolylamino, 4-(3-sulfobenzamido) anilino, 4-cyanophenylamino, 2-trifluoromethylphenylamino, benzothiazolamino, etc.; a carbonamido group, e.g., an alkylcarbonamido group such as ethylcarbonamido, decylcarbonamido, phenylethylcarbonamido, etc., an arylcarbonamido group such as phenylcarbonamido, 2,4,6-trichlorophenylcarbonamido, 4-methylphenylcarbonamido, 2-ethoxyphenylcarbonamido, 3-[α-(2,4-ditertamylphenoxy) acetamido]benzamido, naphthylcarbonamido, etc., and a heterocyclic carbonamido group such as thiazolylcarbonamido, benzothiazolylcarbonamido, naphthothiazolylcarbonamido, oxazolylcarbonamido, benzoxazolylcarbonamido, imidazolylcarbonamido, benzimidazolylcarbonamido, etc.; a sulfonamido group, e.g., an alkylsulfonamido group such as butylsulfonamido, dodecylsulfonamido, phenylethylsulfonamido, etc., an arylsulfonamido group such as phenylsulfonamido, 2,4,6-trichlorophenylsulfonamido, 2-1 -methoxyphenylsulfonamido, 3-carboxyphenylsulfonamido, naphthylsulfonamido, etc., and a heterocyclic sulfonamido group such as thiazolylsulfonamido, benzothiazolylsulfonamido, imidazolylsulfonamido, benzimidazolylsulfonamido, pyridylsulfonamido, etc.; a sulfamyl group, e.g., an alkylsulfamyl group such as propylsulfamyl, octylsulfamyl, pentadecylsulfamyl, octadecylsulfamyl, etc., an arylsulfamyl group such as phenylsulfamyl, 2,4,6-trichlorophenylsulfamyl, 2-methoxyphenylsulfamyl, naphthylsulfamyl, etc., and a heterocyclic sulfamyl group such as thiazolylsulfamyl, benzothiazolylsulfamyl, oxazolylsulfamyl, benzimidazolylsulfamyl, pyridylsulfamyl, etc.; and a carbamyl group, e.g., an alkylcarbamyl group such as ethylcarbamyl, octylcarbamyl, pentadecylcarbamyl, octadecylcarbamyl, etc., an arylcarbamyl group such as phenylcarbamyl, 2,4,6-trichlorophenylcarbamyl, etc., and a heterocyclic carbamyl group such as thiazolylcarbamyl, benzothiazolylcarbamyl, oxazolylcarbamyl, imidazolylcarbamyl, benzimidazolylcarbamyl, etc. $R^{46}$, $R^{47}$, $R^{48}$ and $R^{49}$ each represents one of the groups defined as $R^{45}$, and W represents non-metal atoms necessary to form a 5- or 6-membered ring described below by fusing with the benzene ring. Suitable examples of the 5- or 6-membered ring include a benzene ring, a cyclohexene ring, a cyclopentene ring, a thiazole ring, an oxazole ring, an imidazole ring, a pyridine ring, a pyrrole ring, a tetrahydropyridine ring and so on.

Specific examples of the high reaction rate couplers represented by the general formulae (CV) to (CVIII) are illustrated below. However, those which can be employed in this invention should not be construed as being limited to the following examples.

CV-1
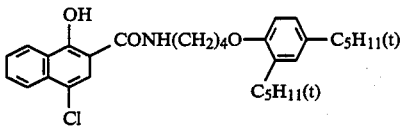
CV-2
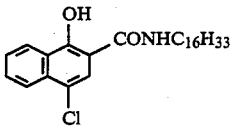
CV-3
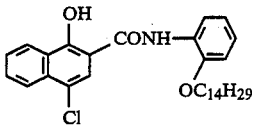
CV-4
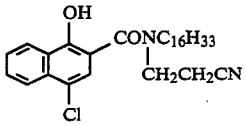
CV-5
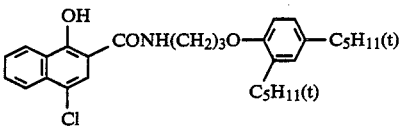
CV-6
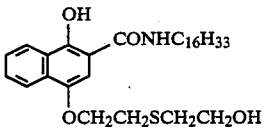
CV-7
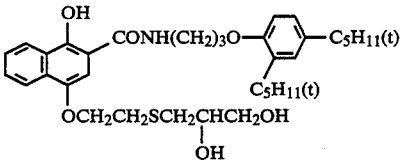
CV-8
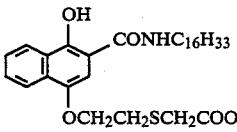
CV-9
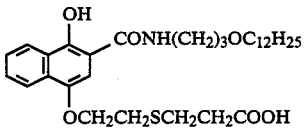
CV-10
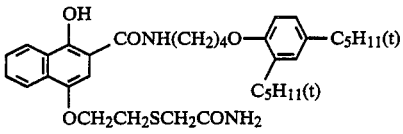
CV-11
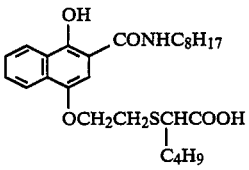
-continued
CV-12
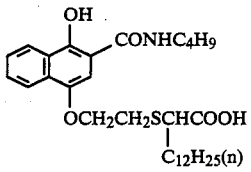
CV-13
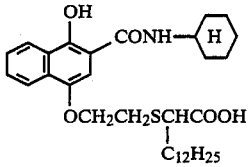
CV-14
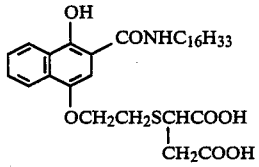
CV-15
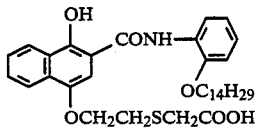
CV-16
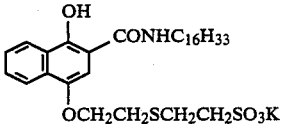
CV-17
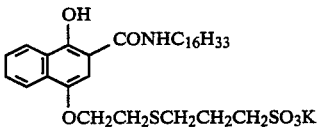
CV-18
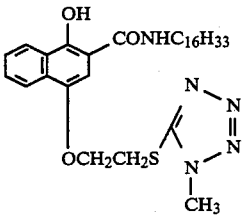
CV-19
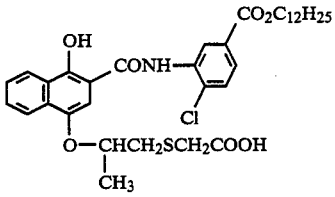
CV-20
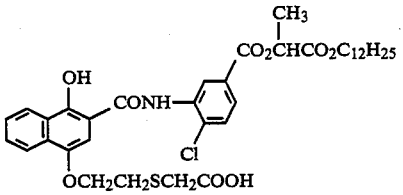

-continued
CV-21
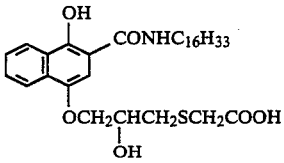
CV-22
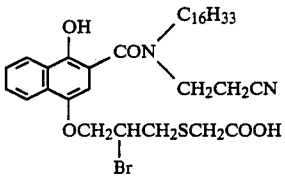
CV-23
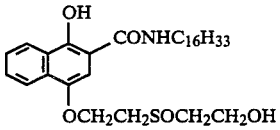
CV-24
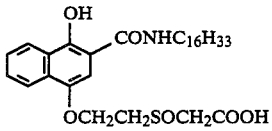
CV-25
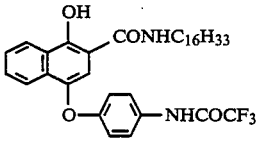
CV-26
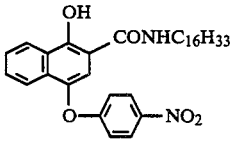
CV-27
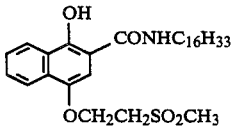
CV-28
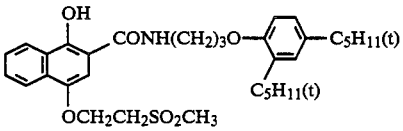
CV-29
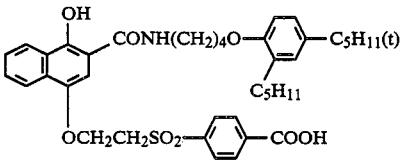
CV-30
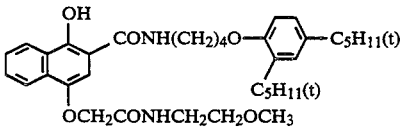
-continued
CV-31
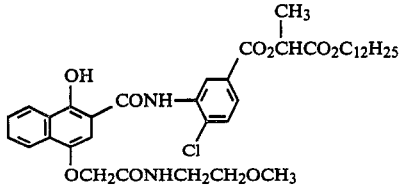
CV-32
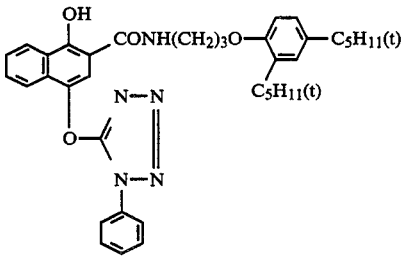
CV-33
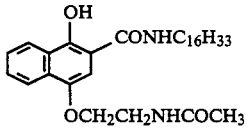
CV-34
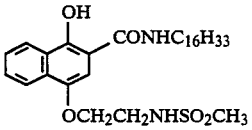
CV-35
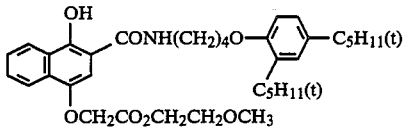
CV-36
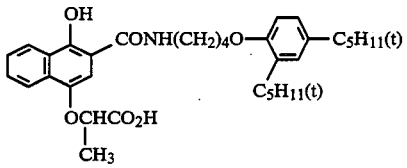
CV-37
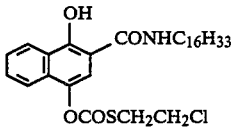
CV-38
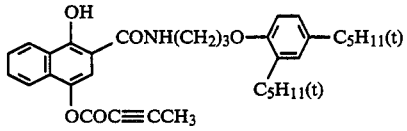
CV-39
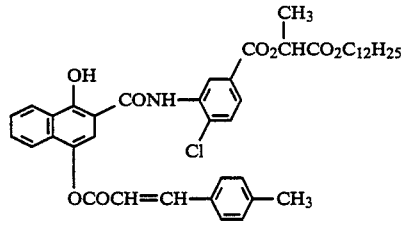

-continued

CV-40

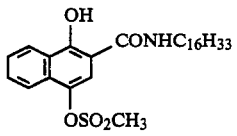

CV-41

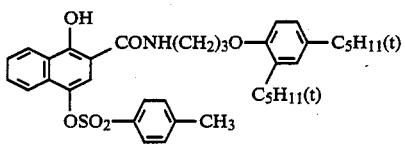

CV-42

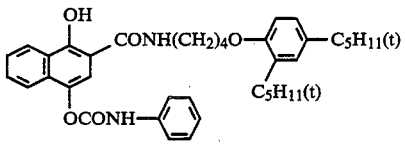

CV-43

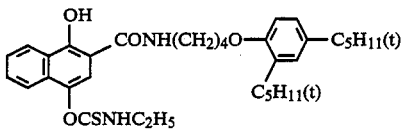

CV-44

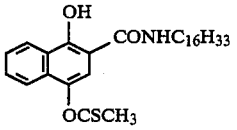

CV-45

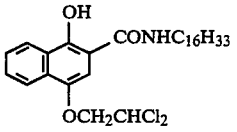

CV-46

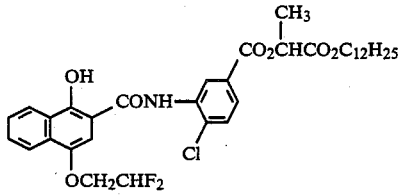

CV-47

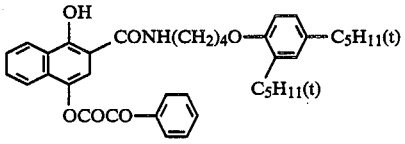

CV-48

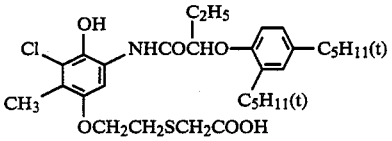

CV-49

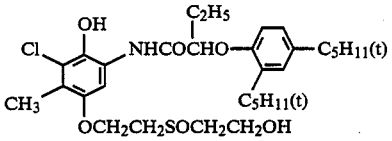

-continued

CV-50

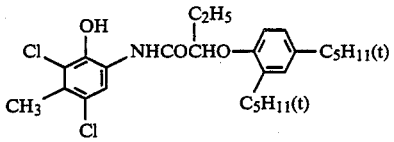

CV-51

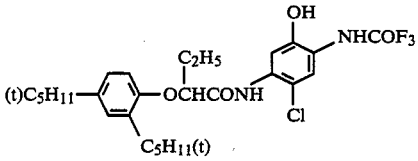

CV-52

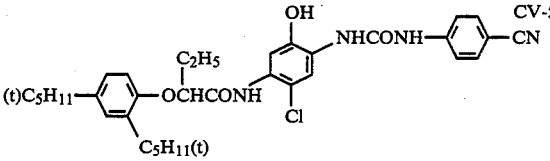

CV-53

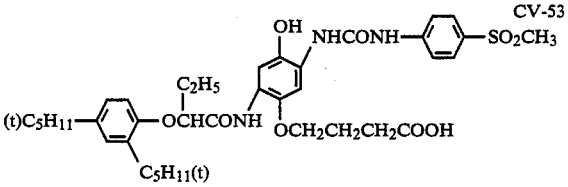

CV-54

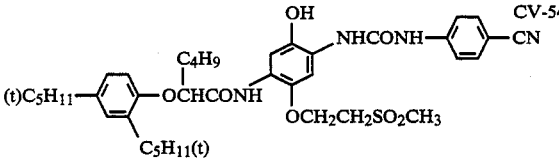

CV-55

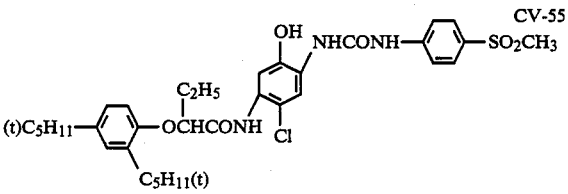

CV-56

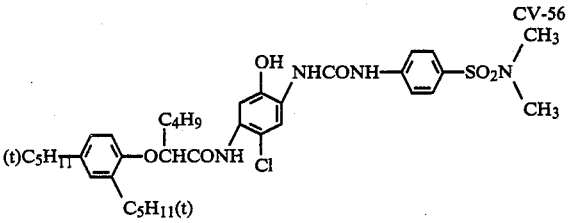

All of couplers represented by the general formulae (CI) to (CV) are known compounds. For instance, those which are represented by the general formulae (CI) to (CIII) are described in Japanese patent publication No. 10783/76, Japanese patent application (OPI) Nos. 66834/73 , 66835/73, 102636/76, 122335/74, 34232/75, 9529/78, 39126/78, 47827/78 and 105226/78, Japanese patent publication No. 13576/74, Japanese patent application (OPI) Nos. 89729/76 and 75521/76, U.S. Pat. Nos. 4,059,447 and 3,894,875, and so on. Couplers represented by the general formula (CIV) are described in Japanese patent application (OPI) Nos. 122935/75, 126833/81, 38043/81, 46223/81, 58922/77, 20826/76, 122335/74 and 159336/75, Japanese patent publication Nos. 10100/76 and 37540/75, Japanese patent application (OPI) Nos. 112343/76, 47827/78 and 39126/78, Japanese patent publication No. 15471/70, U.S. Pat. No. 3,227,554, and RD 16,140. Couplers represented by the general formula (CV) are described in Japanese patent application (OPI) Nos. 27147/81, 1938/81, 117422/75, 37425/72, 48237/79, 52423/78, 105226/78, 45524/78, 47827/78, 39745/78, 10135/75 and 120334/75, U.S. Pat. No. 3,476,563, and so on.

Especially good results are obtained when the combination of couplers characteristic of this invention is further combined wth a DIR coupler which contains a splitting-off group having great diffusibility or a DIR coupler having such a timing group as described in Japanese patent application (OPI) No. 145135/69 or British patent application (OPI) No. 2,072,365A.

As a binder or protective colloid for photographic emulsions, it is advantageous to use gelatin, although other hydrophilic colloids can be used. For example, proteins, such as gelatin derivatives, graft polymers of gelatin and other polymers, albumin and casein; cellulose derivatives, such as hydroxyethyl cellulose, carboxymethyl cellulose, and cellulose sulfuric acid esters; sugar derivatives, such as sodium alginate, starch derivatives; and a wide variety of hydrophilic synthetic homo- or copolymers, such as polyvinyl alcohol, polyvinyl alcohol partial acetal, poly(N-vinyl) pyrrolidone, polyacrylic acid, polymethacrylic acid, polyacrylamide, polyvinyl imidazole, and polyvinyl pyrazole, can be used.

In addition to lime-processed gelatin, acid-processed gelatin and enzyme-processed gelatin as described in *Bull. Soc. Sci. Phot. Japan,* No. 16, page 30 (1966) may be used as gelatin. In addition, hydrolyzates and enzymatic decomposition products of gelatin can be used.

Gelatin derivatives which can be used are those prepared by reacting gelatin with, e.g., acid halide, acid anhydride, isocyanates, bromoacetic acid, alkanesultones, vinylsulfonamides, maleimide compounds, polyalkylene oxides, and epoxy compounds. Typical examples are described in, for example, U.S. Pat. Nos. 2,614,928, 3,132,945, 3,186,846, 3,312,553, British Pat. Nos. 861,414, 1,033,189, 1,005,784, and Japanese patent publication No. 26845/67.

Gelatin graft polymers which can be used are those compounds resulting from graft polymerization of homo- or copolymers of vinyl-based monomers, such as acrylic acid, methacrylic acid, their ester, amido or like derivatives, acrylonitrile, and styrene, on gelatin. In particular, graft polymers of gelatin and polymers of, e.g., acrylic acid, methacrylic acid, acrylamide, methacrylamide, or hydroxyalkyl methacrylate, having certain compatibility with gelatin are preferred. These examples are described in, for example, U.S. Pat. Nos. 2,763,625, 2,831,767 and 2,956,884.

Typical examples of hydrophilic synthetic polymers are described in, for example, West German patent application (OLS) No. 2,312,708, U.S. Pat. Nos. 3,620,751, 3,879,205 and Japanese patent publication No. 7561/68.

In the photographic emulsion layer to be employed in this invention, any of silver bromide, silver iodobromide, silver iodochlorobromide, silver chlorobromide, and silver chloride can be used as the silver halide. A preferred example is silver iodobromide containing 2 mole % or more of silver iodide.

Photographic emulsions as used herein can be prepared in any suitable manner, e.g., by the methods described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, rhodium salts or its complex salts, iron salts or its complex salts, and the like.

In photographic emulsion layers or other hydrophilic colloid layers of the light-sensitive material of the invention can be incorporated various surface active agents as coating aids or for other various purposes, e.g., prevention of charging, improvement of slipping properties, acceleration of emulsification and dispersion, prevention of adhesion, and improvement of photographic characteristics (particularly development acceleration, high contrast, and sensitization).

Surface active agents which can be used are nonionic surface active agents, e.g., saponin (steroid-based), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts), gylcidol derivatives (e.g., alkenylsuccinic acid polyglyceride and alkylphenol polyglyceride), aliphatic acid esters of polyhydric alcohols, and alkyl esters of sugar; anionic surface active agents containing acidic groups, such as a carboxyl group, a sulfo group, a phospho group, a sulfuric acid ester group, and a phosphoric acid ester group, for example, alkylcarboxylic acid salts, alkylsulfonic sulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters; amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layer of the color photographic light-sensitive material of the invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development. For example, the compounds described in, for example, U.S. Pat. Nos. 2,400,532, 2,423,549, 2,716,062, 3,617,280, 3,772,021, 3,808,003, and British Pat. No. 1,488,991 can be used.

In photographic emulsion layers or other hydrophilic colloid layers of the photographic light-sensitive material of the invention can be incorporated water-insoluble or sparingly soluble synthethic polymer dispersions for the purpose of improving dimensional stability. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, and styrene, and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid. For example, the polymers described in U.S. Pat. Nos. 2,376,005, 2,739,137, 2,853,457, 3,062,674, 3,411,911, 3,488,708, 3,525,620, 3,607,290, 3,635,715, 3,645,740, British Pat. Nos. 1,186,699, and 1,307,373 can be used.

In photographic processing of layers composed of photographic emulsions in the color photographic light-sensitive material of the invention, any of known procedures and known processing solutions, e.g., those described in *Research Disclosure,* No. 176, pp. 28–30 (RD-17643), can be used. This photographic processing may be a photographic processing (black-and-white photographic process) to form silver images or a photographic processing (color photographic process) to form dye images depending on the purpose. The processing temperature is usually chosen from between 18° C. and 50° C., although it may be lower than 18° C. or higher than 50° C.

Any fixers which are generally used can be used in the invention. As fixing agents, thiosulfuric acid salts and thiocyanic acid salts, and in addition, organic sulfur compounds which are known effective as fixing agents can be used. These fixers may contain water-soluble aluminum salts as hardeners.

Formation of dye images can be achieved by the usual method. For example, a negative-positive process (described in, for example, *Journal of the Society of Motion Picture and Television Engineers,* Vol. 61, pp. 667–701 (1953)); the color reversal process which comprises forming negative silver image through development using a developing solution containing a black-and-white developing agent, carrying out at least one uniform exposure or another appropriate fogging treatment, and carrying out color development to produce a positive dye image; silver dye bleach process which comprises forming silver image by developing an exposed dye-containing photographic emulsion layers, and bleaching dyes utilizing the silver image as catalyst; and so on can be employed.

Color developers are usually alkaline aqueous solutions containing color developing agents. As these color developing agents, known primary aromatic amine compounds, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, and 4-amino-3-methyl-N-ethyl-N-$\beta$-methoxyethylaniline, can be used.

In addition, the compounds described in L.F.A. Mason, *Photographic Processing Chemistry,* Focal Press, pp. 226–229 (1966), U.S. Pat. Nos. 2,193,015, 2,592,364, Japanese patent application (OPI) No. 64933/73, etc., may be used.

The color developers can further contain pH buffers, development inhibitors, antifoggants, and so forth. If necessary, hard water-softening agents, preservatives, organic solvents, development accelerators, dye forming couplers, competitive couplers, foggants, auxiliary developing agents, tackifiers, polycarboxylic acid-based chelating agents, antioxidants and the like may be incorporated.

Specific examples of such additives are described in, for example, *Research Disclosure* (RD-17643), U.S. Pat. No. 4,083,723, and West German Pat. (OLS) No. 2,622,950.

After the color development, the photographic emulsion layer is usually bleached. This bleach processing may be performed simultaneously with a fix processing, or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of organic acids, such as aminopolycarboxylic acids (e.g., ethylenediaminetetraacetic acid, nitrilotriacetic acid and 1,3-diamino-2-propanoltetraacetic acid) or organic acids (e.g., citric acid, tartaric acid and malic acid); persulfates; permanganates; and nitrosophenol can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a combined bleach-fixing solution.

In bleaching or bleach-fixing solutions can be incorporated various additives, such as bleach accelerators as described in U.S. Pat. Nos. 3,042,520, 3,241,966, Japanese patent publication Nos. 8506/70 and 8836/70, and thiol compounds as described in Japanese patent application (OPE) No. 65732/78.

Photographic emulsions as used herein may be spectrally sensitized with, for example, methine dyes.

Useful sensitizing dyes are described in, for example, German Pat. No. 929,080, U.S. Pat. Nos. 2,493,748, 2,503,776, 2,519,001, 2,912,329, 3,656,959, 3,672,897, 4,025,349, British Pat. No. 1,242,588, and Japanese patent publication No. 14030/69. These sensitizing dyes may be used individually or in combination with each other. Combinations of sensitizing dyes are often used particularly for the purpose of super-sensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, 4,026,707 British Pat. No. 1,344,281, Japanese patent publication Nos. 4936/68, 12375/78, Japanese patent application (OPI) Nos. 110618/77 and 109925/77.

The present invention may include a multilayer polycolor photographic material having at least two different spectral sensitivities. This type of multilayer polycolor photographic material usually comprises a support, and at least one red-sensitive emulsion layer, at least one green-sensitive emulsion layer, and at least one blue-sensitive emulsion layer provided on the support. These emulsion layers can be provided in any desired order. Usually, a cyan-forming coupler is incorporated in the red-sensitive emulsion layer, a magenta-forming coupler in the green-sensitive emulsion layer, and a yellow-forming coupler in the blue-sensitive layer. In some cases, different combinations can be used.

The color photographic light-sensitive material of the invention may contain inorganic or organic hardeners in the photographic emulsion layers and other hydrophilic colloid layers thereof. For example, chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine, and 1,3-vinylsulfonyl-2-propanol), active halogen compounds (2,4-dichloro-6-hydroxy-s-triazine), and mucohalogenic acids (e.g., mucochloric acid and mucophenoxychloric acid) can be used alone or in combination with each other.

The color photographic light-sensitive material of the invention may contain ultraviolet absorbers in the hydrophilic colloid layer thereof. Ultraviolet absorbers which can be used include benzotriazole compounds substituted with an aryl group, 4-thiazolidone compounds, benzophenone compounds, cinnamic acid ester compounds, butadiene compounds, benzoxazole compounds, and the like. In addition, polymers having an ultraviolet ray-absorbing ability can be used. These ultraviolet absorbers may be fixed in the foregoing colloid layer.

Typical examples of ultraviolet absorbers are described in, for example, U.S. Pat. Nos. 3,533,794, 3,314,794, 3,352,681, Japanese patent application (OPI) No. 2784/71, U.S. Pat. Nos. 3,705,805, 3,707,375, 4,045,229, 3,700,455, 3,499,762, and West German patent publication No. 1,547,863.

The color photographic light-sensitive material of the invention may contain water-soluble dyes in the hydrophilic colloid layer thereof as filter dye or for various purposes, e.g., irradiation prevention. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

Specific examples of dyes which can be employed for the above-described purposes are described in British Pat. Nos. 546,708; 584,609; 1,265,842 and 1,410,488: and U.S. Pat. Nos. 2,274,782; 2,286,714; 2,526,632; 2,606,833; 2,956,879; 3,148,187; 3,247,127; 3,481,927; 3,575,704; 3,653,905 and 3,718,472.

In the photographic emulsion layers of the color photographic light-sensitive material of the invention, conventional color-forming couplers, i.e., compounds capable of forming color through an oxidative coupling reaction with aromatic primary amine developing agents (e.g., phenylenediamine derivatives and aminophenol derivatives) at color development may be used in combination with the diffusing dye-forming coupler and the high reaction rate coupler of the invention. Examples of magenta couplers include a 5-pyrazolone coupler, a pyrazolobenzimidazole coupler, a cyanoacetylcumaron coupler, and an open-chain acylacetonitrile coupler; examples of yellow couplers include acylacetamide couplers (e.g., benzoylacentanilides and pivaloylacetanilides); and examples of cyan couplers include a naphthol coupler and a phenol coupler.

These couplers desirably have a hydrophobic group called a ballast group in the molecule thereof, being non-diffusing. The couplers may be either of 4-equivalent or 2-equivalent per silver ion. In addition, they may be colored couplers having a color correction effect, or couplers (so-called DIR couplers) releasing a development inhibitor as development advances. Other than DIR couplers, colorless DIR coupling compounds, the coupling reaction product of which is colorless, and which release a development inhibitor may be incorporated.

The coupler can be incorporated in a silver halide emulsion layer by any known technique, such as the method described in U.S. Pat. No. 2,322,027. For example, the coupler is dissolved in high boiling organic solvents, for example, phthalic acid alkyl esters (e.g., dibutyl phthalate and dioctyl phthalate), phosphoric acid esters (e.g., diphenyl phosphate, triphenyl phosphate, tricresyl phosphate and dioctylbutyl phosphate), citric acid esters (e.g., tributyl acetylcitrate), benzoic acid esters (e.g., octyl benzoate), alkylamides (e.g., diethyllaurylamide), aliphatic acid esters (e.g., dibutoxyethyl succinate and dioctyl azelate), or trimesic acid esters (e.g., tributyl trimesate), or organic solvents having a low boiling point of from about 30° to about 150° C., for example, lower alkyl acetates such as ethyl acetate and butyl acetate, ethyl propionate, sec-butyl alcohol, methyl isobutyl ketone, β-ethoxyethyl acetate, and methyl cellosolve acetate and, thereafter, is dispersed in hydrophilic colloid. The above-described high boiling and low boiling organic solvents may be used in combination with each other. In addition, a dispersion procedure using polymers, as described in Japanese patent publication No. 39853/76 and Japanese patent application (OPI) No. 59943/76, can be used.

When the coupler contains an acid group, e.g., a carboxyl group and a sulfonyl group, it is incorporated in hydrophilic colloid in the form of an alkali aqueous solution.

The present invention is explained in greater detail with reference to the examples below, but the present invention should not be construed as being limited thereto.

EXAMPLE 1

Color negative materials constructed by the layers having compositions described below were prepared.

Second Layer:
- Gelatin, and
- Hardener (1,3-Vinylsulfonyl-2-propanol)

First Layer:
- Spectrally sensitized silver halide emulsion,
- Gelatin,
- Surface active agent (Sodium Dodecyl-benzenesulfonate),
- Coupler M-3,
- Coupler CIV-27, and
- Coupler solvent (Tricresyl Phosphate)

Support: Cellulose acetate film

Proportions of the couplers used in each sample were as follows.

| Sample No. | Coupler M-3 | Coupler CIV-27 |
|---|---|---|
| 101 | 100 mole % | — |

-continued

| Sample No. | Coupler M-3 | Coupler CIV-27 |
|---|---|---|
| 102 | — | 100 mole % |
| 103 | 80 mole % | 20 mole % |
| 104 | 50 mole % | 50 mole % |

Each of samples 101 to 104, in which grain sizes of their respective silver halide emulsions were so controlled as to gain sensitivities and gradations equivalent to one another notwithstanding the difference in proportions of couplers incorporated, was exposed to white light and then, subjected to the following development processing at a temperature of 38° C.

| Steps for Processing | Time |
|---|---|
| 1. Color Development | 3 min. 15 sec. |
| 2. Bleaching | 6 min. 30 sec. |
| 3. Washing | 3 min. 15 sec. |
| 4. Fixation | 6 min. 30 sec. |
| 5. Washing | 3 min. 15 sec. |
| 6. Stabilization | 3 min. 15 sec. |

Compositions of processing solutions used in the above-described steps respectively were as follows.

| | |
|---|---|
| Composition of Color Developing Solution: | |
| Sodium Nitrotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methyl-aniline Sulfate | 4.5 g |
| Water to make | 1 l |
| Composition of Bleaching Solution: | |
| Ammonium Bromide | 160.0 g |
| Ammonia Water (28%) | 25.0 ml |
| Sodium Ethylenediaminetetraacetonato-ferrate (III) | 130 g |
| Glacial Acetic Acid | 14 ml |
| Water to make | 1 l |
| Composition of Fixing Solution: | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 l |
| Composition of Stabilizing Solution: | |
| Formaline | 8.0 ml |
| Water to make | 1 l |

Granularity of magenta dye image produced in each sample was judged using the conventional R.M.S. method. Judgement of granularity by the R.M.S. method has been prevailing employed by one skilled in the art. For details of such a method *The Theory of the Photografic Process*, 4th Ed., p. 619 should be referred to. A size of the aperture employed in the measurement was 10μ.

Each of samples 101 to 104 was worked into photographic films of 110 size, and applied to practical photographing. Then, the image obtained was printed on photographic paper of cabinet size, and psychological evaluation of the resulting graininess was carried out. The thus obtained values of R.M.S. granularity and results of psychological evaluation are summarized in Table 1.

Making an additional remark, the Coupler CIV-27 had a coupling speed higher than that of the Coupler M-3 by a factor of 2.1.

TABLE 1

| Sample No. | Magenta R.M.S. Value $D = D_{min.} + 0.2$ | $D = D_{min.} + 0.8$ | Psychological Evaluation of Graininess |
|---|---|---|---|
| 101 (Comparison) | 0.035 | 0.025 | Large mottles stood out in areas of middle and higher densities. |
| 102 (Comparison) | 0.066 | 0.018 | Graininess was conspicuous in low density part. |
| 103 (Invention) | 0.032 | 0.018 | Graininess was inconspicuous and large mottles were absent. |
| 104 (Invention) | 0.036 | 0.016 | Graininess was inconspicuous and large mottles were absent. |

As shown in Table 1, in case of independent use of the diffusing dye-forming coupler (Coupler M-3) (Sample No. 101) the low density part had a small R.M.S. value and psychologically favorable graininess, whereas from middle densities to high densities R.M.S. values were little decreased and uneven large mottles were conspicuous, that is, the middle and the high density parts had undesirable graininess. On the other hand, in case of independent use of the high reaction rate coupler (Coupler CIV-27) (Sample No. 102) large mottles were not observed, but the R.M.S. value was very large in the low density part and graininess was conspicuous therein. As can be seen from the results of Sample 103 and Sample 104, R.M.S. values were kept very small and psychologically favorable graininess was also obtained over the whole density region by using both diffusing dye-forming coupler and high reaction rate coupler in a proper mixing ratio.

EXAMPLE 2

On a polyethylene terephthalate film support, were coated the layers described below in this order to prepare a multilayer color light-sensitive material.

The First Layer: Antihalation layer which was a gelatin layer containing black colloidal silver.

The Second Layer: Interlayer which was a gelatin layer containing an emulsified dispersion of 2,5-di-t-octylhydroquinone.

The Third Layer: First red-sensitive emulsion layer containing a silver iodobromide emulsion (containing 5 mole % of silver iodide and 1.7 g/m$^2$ of silver), the sensitizing dye I in a content of $6\times10^{-5}$ mole of silver, the sensitizing dye II in a content of $1.5\times10^{-5}$ mole per mole of silver, the coupler EX-1 in a content of 0.04 mole per mole of silver, the coupler EX-5 in a content of 0.003 mole per mole of silver, and the coupler EX-6 in a content of 0.0006 mole per mole of silver.

The Fourth Layer: Second red-sensitive emulsion layer containing a silver iodobromide emulsion (containg 7 mole % of silver iodide and 1.4 g/m$^2$ of silver), the sensitizing dye I in a content of $3\times10^{-5}$ mole per mole of silver, the sensitizing dye II in a content of $1.2\times10^{-5}$ mole per mole of silver, the coupler EX-2 in a content of 0.02 mole per mole of silver, and the coupler EX-5 in a content of 0.0016 mole per mole of silver.

The Fifth Layer: Interlayer which was the same one as the second layer.

The Sixth Layer: First green-sensitive emulsion layer containing a silver iodobromide emulsion (containing 4 mole % of silver iodide and 1.5 g/m$^2$ of silver), the sensitizing dye III in a content of $3\times10^{-5}$ mole per mole of silver, the sensitizing dye IV in a content of $1\times10^{-5}$ mole per mole of silver, the combination of the Coupler M-3 and the Coupler CIV-27 in a total content of 0.05 mole per mole of silver, the coupler EX-8 in a content of 0.008 mole per mole of silver, and the coupler EX-6 in a content of 0.0015 mole per mole of silver.

The Seventh Layer: Second green-sensitive emulsion layer containing a silver iodobromide emulsion (containing 6 mole % of silver iodide and 1.6 g/m$^2$ of silver), the sensitizing dye III in a content of $2.5\times10^{-5}$ mole per mole of silver, the sensitizing dye IV in a content of $0.8\times10^{-5}$ mole per mole of silver, and the combination of the Coupler M-3 and the Coupler CIV-27 in a total content of 0.02 mole per mole of silver.

The Eighth Layer: Yellow filter layer which was a gelatin layer containing yellow colloidal silver and an emulsified dispersion of 2,5-di-t-octylhydroquinone in a gelatin aqueous solution.

The Nineth Layer: First blue-sensitive emulsion layer containing a silver iodobromide emulsion (containing 6 mole % of silver iodide and 1.5 g/m$^2$ of silver), the coupler EX-9 in a content of 0.25 mole per molê of silver, and the coupler EX-6 in a content of 0.015 mole per mole of silver.

The Tenth Layer: Second blue-sensitive emulsion layer containing a silver iodobromide emulsion (containing 6 mole % of silver iodide and 1.1 g/m$^2$ of silver), and the coupler EX-9 in a content of 0.06 mole per mole of silver.

The Eleventh Layer: First protective layer which was a gelatin layer containing 0.5 g of silver iodobromide (containing 1 mole % of silver iodide and having a mean grain size of 0.07$\mu$), and an emulsified dispersion of the ultraviolet absorbing agent UV-1.

The Twelveth Layer: Second protective layer which was a gelatin layer containing polymethylmethacrylate particles (having a diameter of about 1.5$\mu$).

In addition to the above-described composition, the gelatin hardener H-1 and a surface active agent were added to each layer.

The compounds employed for preparing this sample were described below:

Sensitizing Dye I: Pyridinium salt of anhydro-5,5'-dichloro-3,3'-di-($\gamma$-sulfopropyl)-9-ethyl-thiacarbocyanine hydroxide.

Sensitizing Dye II: Triethylamine salt of anhydro-9-ethyl-3,3'-di-($\gamma$-sulfopropyl) -4,5,4',5'-dibenzothiacarbocyanine hydroxide.

Sensitizing Dye III: Sodium salt of anhydro-9-ethyl-5,5'-dichloro-3,3'-di-($\gamma$-sulfopropyl)oxacarbocyanine.

Sensitizing Dye IV: Sodium salt of anhydro-5,6,5',6'-tetrachloro-1,1'-diethyl-3,3'-di-[$\beta$-{$\beta$-($\gamma$-sulfopropyl-)ethoxy}ethyl]- imidazolocarbocyanine hydroxide.

Coupler EX-1

-continued

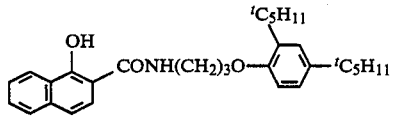

Coupler EX-2

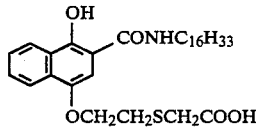

Coupler EX-3

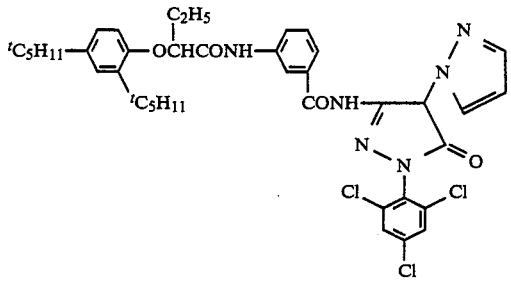

Coupler EX-4

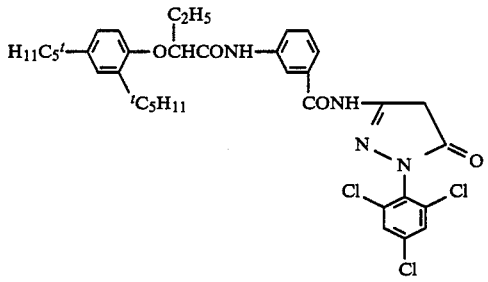

Coupler EX-5

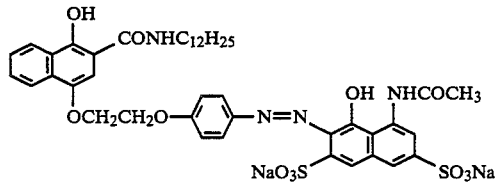

Coupler EX-6

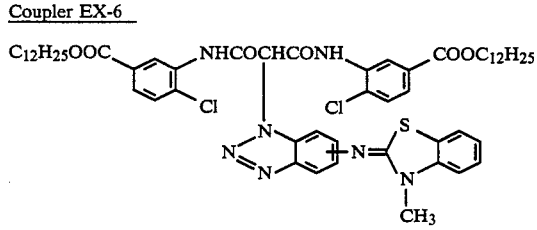

Coupler EX-7

-continued

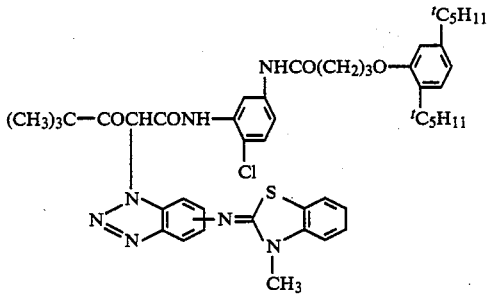

Coupler EX-8

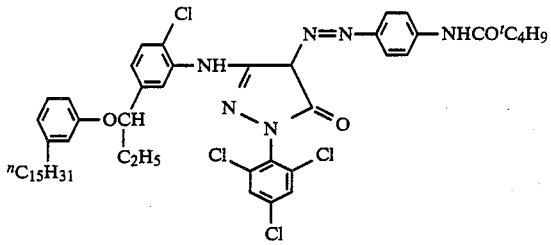

Coupler EX-9

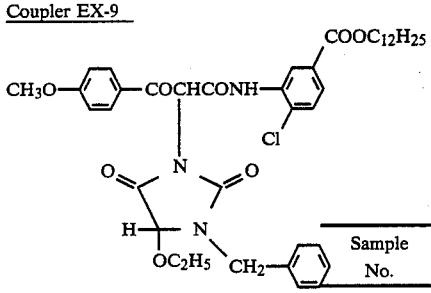

Coupler EX-10

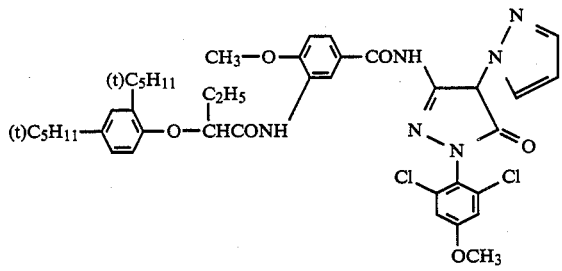

Hardener H-1

-continued

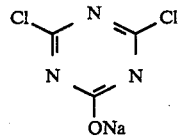

Samples which contained the Coupler M-3 and the Coupler CIV-27 in the 6th layer or/and the 7th layer of the above-described formula in mole proportions set forth in the following Table 2 were numbered from 201 to 204.

TABLE 2

| Sample No. | The 6th Layer M-3 | The 6th Layer CIV-27 | The 7th Layer M-3 | The 7th Layer CIV-27 |
|---|---|---|---|---|
| 201* | 100 mole % | — | 100 mole % | — |
| 202* | — | 100 mole % | — | 100 mole % |
| 203** | — | 100 mole % | 100 mole % | — |
| 204** | 20 mole % | 80 mole % | 80 mole % | 20 mole % |

*Comparison
**Invention

Each of samples 201 to 204 was exposed and developed in the same manner as described in Example 1. Thereafter, the resulting graininess was evaluated using the same methods as described in Example 1. In addition, Wiener spectra of magenta images produced in some of these samples were measured.

The thus obtained characteristic values of R.M.S. granularity and results of psychological evaluation are summarized in Table 3.

TABLE 3

| Sample No. | Magenta R.M.S. Value $D = D_{min.} + 0.2$ | $D = D_{min.} + 0.8$ | $D = D_{min.} + 1.5$ | Psychological Evaluation of Graininess |
|---|---|---|---|---|
| 201 (Comparison) | 0.070 | 0.063 | 0.032 | Large mottles stood out in areas of middle and higher densities. |
| 202 (Comparison) | 0.083 | 0.062 | 0.022 | Graininess was poor in low density area. |
| 203 (Invention) | 0.070 | 0.056 | 0.021 | Graininess was good over whole density region. |
| 204 (Invention) | 0.072 | 0.054 | 0.018 | Graininess was excellent over whole density region. |

As is apparent from the above-described experimental results, although it was difficult to prepare a color negative material excellent in graininess in case of independent use of the diffusing dye-forming coupler or the high reaction rate coupler, it has become feasible to provide a sensitive material excellent in both characteristic values of R.M.S. granularity and psychological graininess over the whole density region by the combined use of the above-described couplers in a proper mixing ratio.

It has also proved that if the high reaction rate coupler is used in a larger proportion in the 6th layer (low sensitive emulsion layer) and the diffusing dye-forming coupler is used in a larger proportion in the 7th layer (high sensitive emulsion layer), especially favorable graininess can be attained.

As shown in FIG. 1, the Wiener spectrum of Sample 201 using the diffusing dye-forming coupler alone was high especially at low spatial frequencies. This was consistent with the experimental result for psychological evaluation that the generation of large mottles were observed. On the othe hand, the Wiener spectrum of Sample 202 using the high reaction rate coupler alone was high especially at intermediate frequencies ranging from 5 to 30 cycle/mm, and implied roughness in graininess attributable to formation of large dye clouds. On the contrary, in Sample 204 using both the diffusing dye-forming coupler and the high reaction rate coupler in a proper mixing ratio, fluctuations of low spatial frequencies, which are the defect of a diffusing dye-forming coupler, were greatly reduced and at the same time, its Wiener spectrum had low values over the whole frequency region. This was consistent with the psychological evaluation of its graininess.

EXAMPLE 3

Samples 301 to 303 were prepared in the same manner as employed in Sample 201 of Example 2 except that compositions of the 3rd layer, the 4th layer, the 6th layer and the 7th layer were changed to those described below, respectively and that, the Coupler C-2 and the Coupler CV-27 were incorporated in such mole proportions as to be set forth in Table 4. Therein, grain sizes of their respective silver halide emulsions were so controlled that these samples may gain almost the same sensitivities and gradations as one another.

Making an additional remark, the Coupler CV-27 had a coupling speed higher than that of the coupler C-2 by a factor of 2.

The Third Layer: First red-sensitive emulsion layer containing a silver iodobromide emulsion (containing 5 mole % of silver iodide and 1.6 g/m$^2$ of silver), the sensitizing dye I in a content of $6\times10^{-5}$ mole per mole of silver, the sensitizing dye II in a content of $1.5\times10^{-5}$ mole per mole of silver, the combination of the Coupler C-2 and the Coupler CV-27 in a total content of 0.04 mole per mole of silver, the coupler EX-5 in a content of 0.003 mole per mole of silver, and the coupler EX-6 in a content of 0.0006 mole per mole of silver.

The Fourth Layer: Second red-sensitive emulsion layer containing a silver iodobromide emulsion (containing 7 mole % of silver iodide and 1.4 g/m$^2$ of silver), the sensitizing dye I in a content of $3\times10^{-5}$ mole per mole of silver, the sensitizing dye II in a content of $1.2\times10^{-5}$ mole per mole of silver, the combination of the Coupler C-2 and the Coupler CV-27 in a total content of 0.02 mole per mole of silver, and the coupler EX-5 in a content of 0.0016 mole per mole of silver.

The Sixth Layer: First green-sensitive emulsion layer containing a silver iodobromide emulsion (containing 4 mole % of silver iodide and 1.2 g/m$^2$ of silver), the sensitizing dye III in a content of $3\times10^{-5}$ mole per mole of silver, the sensitizing dye IV in a content of $1\times10^{-5}$ mole per mole of silver, the coupler EX-4 in a content of 0.05 mole per mole of silver, the coupler EX-8 in a content of 0.008 mole per mole of silver, and the coupler EX-6 in a content of 0.0015 mole per mole of silver.

The Seventy Layer: Second green-sensitive emulsion layer containing a silver iodobromide emulsion (containing 8 mole % of silver iodide and 1.3 g/m$^2$ of silver), the sensitizing dye III in a content of $2.5\times10^{-5}$ mole per mole of silver, the sensitizing dye IV in a content of $0.8\times10^{-5}$ mole per mole of silver, the coupler EX-10 in a content of 0.017 mole per mole of silver, and the coupler EX-3 in a content of 0.05 mole per mole of silver.

Structural formula of the couplers EX-3 to EX-10 are described above in Example 2.

TABLE 4

| Sample | The 3rd Layer | | The 4th Layer | |
|---|---|---|---|---|
| No. | C-2 | CV-27 | C-2 | CV-27 |
| 301* | 100 mole % | — | 100 mole % | — |
| 302* | — | 100 mole % | — | 100 mole % |
| 303** | 40 mole % | 60 mole % | 60 mole % | 40 mole % |

*Comparison
**Invention

Figure 2:
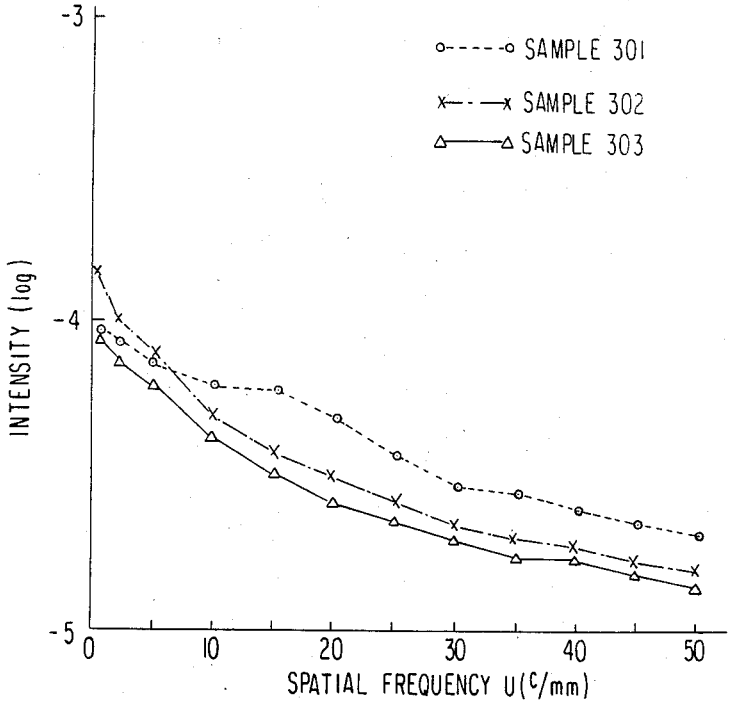
FIG. 2 shows the Wiener spectra of cyan images of Sample 301, Sample 302 and Sample 303 respectively.

Each of lthe samples was exposed and developed in the same manner as described in Example 1. Thereafter, R.M.S. granularity, psychological graininess and Wiener spectrum graininess of these samples were evaluated. The thus obtained values of R.M.S. granularity and results of psychological evaluation of graininess are summarised in Table 5, and the Wiener spectra are shown in FIG. 2.

TABLE 5

| Sample | Cyan R.M.S. Value | | | Psychological Evaluation |
|---|---|---|---|---|
| No. | $D = D_{min.} + 0.2$ | $D = D_{min.} + 0.8$ | $D = D_{min.} + 1.5$ | of Graininess |
| 301 (Comparison) | 0.045 | 0.039 | 0.038 | Great unevenness was conspicuous, and graininess looked bad. |
| 302 (Comparison) | 0.050 | 0.046 | 0.032 | Graininess was conspicuous in low density part. |
| 303 (Invention) | 0.044 | 0.036 | 0.032 | Great unevenness was not observed, and graininess was inconspicuous. |

The graininess was evidently improved by the combined use of the diffusing dye-forming coupler and the high reaction rate coupler, compared with the case of using either of them independently. The graininess attained by such a combined use was excellent over the whole density region from the psychological point of view and from the standpoint of the R.M.S. value.

In addition, the Wiener spectrum of the sample using the combination of the diffusing dye-forming coupler and the high reaction rate couplers had low values (i.e., good graininess) over the whole frequency region.

EXAMPLE 4

The combination of the Coupler M-3 and the Coupler CIV-27 incorporated in Samples 201, 202 and 204 each prepared in Example 2 was changed to the combination of the Coupler M-3 and the Coupler CIV-31, or to the combination of the Coupler M-2 and the Coupler CIV-31, and the resulting samples were subjected to the same experiments for comparison as described in Example 2. Proportions of the couplers employed in these samples were as follows.

TABLE 6 (a)

| Sample No. | 1st Green-sensitive Layer M-3 | 1st Green-sensitive Layer CIV-31 | 2nd Green sensitive Layer M-3 | 2nd Green sensitive Layer CIV-31 |
|---|---|---|---|---|
| 401* | 100 mole % | — | 100 mole % | — |
| 402* | — | 100 mole % | — | 100 mole % |
| 403** | 30 mole % | 70 mole % | 80 mole % | 20 mole % |

*Comparison
**Invention

TABLE 6 (b)

| Sample No. | 1st Green-sensitive Layer M-2 | 1st Green-sensitive Layer CIV-31 | 2nd Green-sensitive Layer M-2 | 2nd Green-sensitive Layer CIV-31 |
|---|---|---|---|---|
| 404* | 100 mole % | — | 100 mole % | — |
| 405* | — | 100 mole % | — | 100 mole % |
| 406** | 20 mole % | 80 mole % | 70 mole % | 30 mole % |

*Comparison
**Invention

A ratio of the coupling reaction speed of the Coupler CIV-31 to that of the Coupler M-3 was 4, whereas a ratio of the coupling reaction speed of the Coupler CIV-31 to that of the Coupler M-2 was 3.2.

Each of these samples 401 to 406 was subjected to development processing and thereafter, R.M.S. values of magenta image produced therein were measured. Results obtained are shown in Table 7.

TABLE 7

| Sample No. | Magenta R.M.S. Value $D = D_{min.} + 0.2$ | $D = D_{min.} + 0.8$ | $D = D_{min.} + 1.5$ |
|---|---|---|---|
| 401 (Comparison) | 0.070 | 0.063 | 0.032 |
| 402 (Comparison) | 0.092 | 0.066 | 0.020 |
| 403 (Invention) | 0.075 | 0.055 | 0.020 |
| 404 (Comparison) | 0.079 | 0.070 | 0.035 |
| 405 (Comparison) | 0.072 | 0.066 | 0.022 |
| 406 (Invention) | 0.080 | 0.061 | 0.018 |

As can be seen from Table 7, the sensitive materials having the constitution of this invention are improved in granularity over the whole density region of magenta dye image.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material, comprising:

a support based having thereon;

a silver halide emulsion layer;

a diffusing dye-forming coupler represented by the general formula (1):

$$(C_p)_aX \quad (1)$$

which can form a dye capable of having moderate diffusibility in an emulsion layer through coupling with an oxidation product of a color developing agent; an wherein $D_p$ represents a diffusible coupler component which allows a dye image to exhibit controlled smearing and improved granularity; X represents a ballast group containing from 8 to 32 carbon atoms which is bound to the coupler component at the coupling position and is released through reaction with an oxidation product of a color developing agent; and a is 1 or 2; and a high reaction rate coupler selected from the general formulae (CI)-(CV):

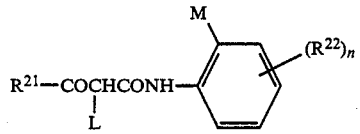
(CI)

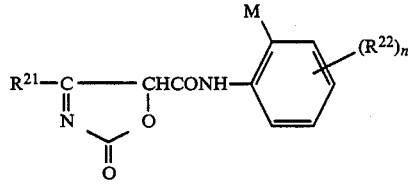
(CII)

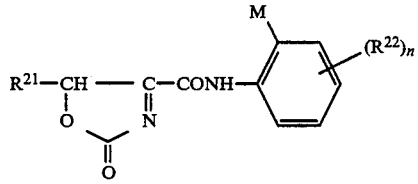
(CIII)

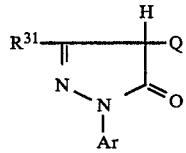
(CIV)

(CV)

which can form a dye of the same color as that of the diffusing dye-forming coupler and that has a coupling speed higher than that of the diffusing dye-forming coupler by a factor of 1.3 to Wherein $R^{21}$ is an alkyl group or an aryl group which may be substituted; $R^{22}$ is a substituent which can be substituted for a hydrogen atom attached to the benzene ring of formula (CIII); and n represents 1 or 2; M represents a halogen atom, an alkoxy group or an aryloxy group; L represents a group capable of being released from coupler upon formation of a dye through oxidative coupling with an aromatic primary amine developer; $R^{31}$ represents an amino group, an acylamino group or a ureido group; Q represents a group capable of being released from the coupler (CIV) upon the formation of a dye through oxidative coupling with an aromatic primary amine developer; Ar represents a phenyl group which may have one or more substituents; A represents an image forming coupler residue which has a naphthol or a phenol nucleus; m represents 1 or 2; and z represents a group which is attached to the coupling site of the above-described coupler residue A and is released from the coupler (CV) when a dye is formed through the oxidation coupling reaction with an aromatic primary amine developer.

2. A silver halide color photographic light-sensitive material as claimed in claim 1, wherein the high reaction rate coupler has a coupling speed higher than that of the diffusing dye-forming coupler by a factor of 1.5 to 10.

3. A silver halide color photographic light-sensitive material as claimed in claim 1, wherein the amount of the diffusing dye-forming coupler is form 0.005 to 0.2 mole per mole of silver.

4. A silver halide color photographic light-sensitive material as claimed in claim 1, wherein the amount of the high reaction rate coupler is from 0.01 mole to 30 moles per mole of the diffusing dye-forming coupler.

5. A silver halide color photographic light-sensitive material as claimed in claim 1, wherein said diffusing dye-forming coupler and said high reaction rate coupler are incorporated in the same layer.

6. A silver halide color photographic light-sensitive material as claimed in claim 1, wherein said diffusing dye-forming coupler and said high reaction rate coupler are incorporated in a group of two or three emulsion layers differing in photographic speed and having the same color sensitivity;

wherein when the group is composed of two layers the high reaction rate coupler is incorporated in a low-sensitive emulsion layer and said diffusing dye-forming coupler is incorporated in a high-sensitive emulsion layer; and wherein when the group is composed of three emulsion layers said high-reaction rate coupler is incorporated in a low-sensitive and intermediate-sensitive layer and said diffusing dye-forming coupler is incorporated in a high-sensitive layer.

7. A silver halide color photographic material as claimed in claim 1, wherein said diffusing dye-forming coupler and said high reaction rate coupler are incorporated in a group of two or three emulsion layers differing in photographic speed and having the same color sensitivity;

wherein more than 50% of said high reaction rate coupler is contained in a low-sensitive emulsion and an intermediate-sensitive emulsion; and wherein more than 50% of said diffusing dye-forming coupler is incorporated in a high-sensitive emulsion.

8. A silver halide color photographic material as claimed in claim 3, wherein the diffusing dye-forming coupler is present in an amount of from 0.01 to 0.05 mole per mole of silver.

9. A silver halide color photographic material as claimed in claim 4, wherein the high reaction rate coupler is present in an amount of from 0.05 mole to 10 moles per mole of the diffusing dye-forming coupler.

* * * * *